US007601681B2

(12) United States Patent
Smets et al.

(10) Patent No.: US 7,601,681 B2
(45) Date of Patent: Oct. 13, 2009

(54) LAUNDRY AND CLEANING AND/OR FABRIC CARE COMPOSITION

(75) Inventors: Johan Smets, Lubbeek (BE); Jean Wevers, Steenhuffel (BE); Gaurav Saini, Kobe (JP); Rafael Trujillo Rosaldo, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/807,738

(22) Filed: May 30, 2007

(65) Prior Publication Data

US 2008/0032910 A1 Feb. 7, 2008

Related U.S. Application Data

(63) Continuation of application No. 11/231,082, filed on Sep. 20, 2005, now abandoned, which is a continuation of application No. 10/168,881, filed as application No. PCT/US00/34833 on Dec. 20, 2000, now abandoned.

(30) Foreign Application Priority Data

| | | |
|---|---|---|
| Dec. 22, 1999 | (EP) | 99870277 |
| Apr. 13, 2000 | (EP) | 00870070 |
| Jun. 22, 2000 | (EP) | 00202168 |

(51) Int. Cl.

| | |
|---|---|
| ***C11D 3/37*** | (2006.01) |
| ***C11D 3/395*** | (2006.01) |
| ***C11D 9/44*** | (2006.01) |

(52) U.S. Cl. ..... 510/475; 510/101; 510/102; 510/103; 510/337; 510/360; 510/361; 8/137

(58) Field of Classification Search ..... 510/101, 510/102, 103, 337, 360, 361, 475; 8/137
See application file for complete search history.

(56) References Cited

U.S. PATENT DOCUMENTS

| | | | | |
|---|---|---|---|---|
| 4,708,821 | A | 11/1987 | Shimokawa et al. | |
| 4,925,653 | A * | 5/1990 | Grollier et al. | 424/47 |
| 5,045,225 | A * | 9/1991 | Aronson et al. | 510/466 |
| 5,780,527 | A * | 7/1998 | O'Leary | 523/102 |
| 6,413,920 | B1 | 7/2002 | Bettiol et al. | |
| 6,451,751 | B1 | 9/2002 | Busch et al. | |
| 6,511,948 | B1 | 1/2003 | Bettiol et al. | |
| 6,566,312 | B2 | 5/2003 | Bettiol et al. | |
| 6,573,228 | B1 | 6/2003 | Littig et al. | |
| 6,699,823 | B2 | 3/2004 | Perneel et al. | |
| 6,740,713 | B1 | 5/2004 | Busch et al. | |
| 6,764,986 | B1 | 7/2004 | Busch et al. | |
| 6,790,815 | B1 | 9/2004 | Bettiol et al. | |
| 6,906,012 | B1 | 6/2005 | Saini et al. | |
| 6,916,769 | B2 | 7/2005 | McRitchie et al. | |
| 2003/0228992 | A1 | 12/2003 | Smets et al. | |

FOREIGN PATENT DOCUMENTS

| | | | |
|---|---|---|---|
| DE | 32 47 709 | A1 | 6/1984 |
| EP | 0 273 775 | A2 | 7/1988 |
| EP | 0 392 619 | A2 | 10/1990 |
| EP | 0 841 391 | A1 | 5/1998 |
| EP | 0 816 484 | A2 | 7/1998 |
| EP | 0 864 642 | A1 | 9/1998 |
| EP | 0 971 024 | A1 | 12/2000 |
| EP | 0 971 025 | A1 | 12/2000 |
| EP | 0 971 026 | A1 | 12/2000 |
| EP | 0 971 027 | A1 | 12/2000 |
| GB | 2 141 726 | A | 1/1985 |
| JP | 56-75159 | A | 6/1981 |
| WO | WO 94/19449 | A1 | 9/1994 |
| WO | WO 97/34982 | | 9/1997 |
| WO | WO 98/28398 | A1 | 7/1998 |
| WO | WO 99/20722 | * | 4/1999 |
| WO | WO 01/21746 | A1 | 3/2001 |
| WO | WO 01/46374 | A1 | 6/2001 |

OTHER PUBLICATIONS

Kamogawa, H., et al. "Chemical Release Control—Schiff Bases of Perfume Aldehydes and Aminostyrenes," Journal of Polymer Science; Polymer Chemistry Edition; vol. 20, 1982, pp. 3121-3129.
Klecan, V. et al., "Stabilisierte Parfumole in Detergentien and Seifen", SOFW-Journal Seifen, Oele, Fette, Washse, De, Verlag fur Chemische Industrie. vol. 116, No. 1, 1990, pp. 11-16, Jan. 1990.
International Search Report for U.S. Appl. No. 10/168,881, Feb. 19, 2001.

* cited by examiner

*Primary Examiner*—Brian P Mruk
(74) *Attorney, Agent, or Firm*—James F. McBride; Kim William Zerby; Steven W. Miller

(57) ABSTRACT

There is provided a laundry and/or cleaning and/or fabric care composition comprising a benefit agent whereby said benefit agent is carried with a carrier material, thereby providing an enhanced deposition on the treated fabric of the benefit agent.

12 Claims, No Drawings

LAUNDRY AND CLEANING AND/OR FABRIC CARE COMPOSITION

CROSS REFERENCE

This application is a continuation of and claims priority under 35 U.S.C. § 120 to U.S. application Ser. No. 11/231,082 filed Sep. 20, 2005, now abandoned which in turn is a continuation of and claims priority under 35 U.S.C. § 120 to U.S. application Ser. No. 10/168,881 filed Dec. 9, 2002, (now abandoned), which is a entry into the U.S. National Stage under 35 U.S.C. § 371 of PCT International Application Serial No. PCT/US00/34833, filed Dec. 20, 2000 which claims priority under 35 U.S.C. § 119 to European Application Serial No. 00202168.1, filed Jun. 22, 2000, and European Application Serial No. 00870070.0 filed Apr. 13, 2000, and European Application Serial No. 99870277.3 filed Dec. 22, 1999.

TECHNICAL FIELD OF THE INVENTION

The present invention relates to a laundry and/or cleaning and/or fabric care composition comprising a benefit agent, for imparting sustained release of the benefit agent on the treated surfaces like fabrics, in particular dry fabrics.

BACKGROUND OF THE INVENTION

Perfumed products are well-known in the art. However, consumer acceptance of such perfumed products like laundry and cleaning products is determined not only by the performance achieved with these products but also by the aesthetics associated therewith. The perfume components are therefore an important aspect of the successful formulation of such commercial products.

It is also desired by consumers for treated surfaces like fabrics to maintain the pleasing fragrance over time. Indeed, perfume additives make such compositions more aesthetically pleasing to the consumer, and in some cases the perfume imparts a pleasant fragrance to surfaces, like fabrics, treated therewith. However, the amount of perfume carried-over from an aqueous laundry or cleaning bath onto fabrics is often marginal and does not last long on the surface. Furthermore, fragrance materials are often very costly and their inefficient use in laundry and cleaning compositions and ineffective delivery to surfaces like fabrics results in a very high cost to both consumers and laundry and cleaning manufacturers. Industry, therefore, continues to seek with urgency for more efficient and effective fragrance delivery in laundry and cleaning products, especially for improvement in the provision of long-lasting fragrance to the surfaces like fabrics. Further, after drying fabrics under the sun, fabrics obtain a "sun-dried type" of odor. Consumers often prefer this to a standard perfume odor. Also they often consider fabrics with these odors to be cleaner. Because consumers like the odor, they like to dry fabrics under the sun. In some countries, however, consumer cannot dry their fabrics outside because the air is not clean, or there is too much rain. As a result, they have to dry their fabrics indoors and cannot expect to enjoy this benefit of having a "sun-dried type" of odor on their fabrics.

Recently, a new class of materials, namely the amine reaction product of a compound containing a primary amine functional group and an active ketone or aldehyde containing component, have found increasing use in the domestic treatment of fabrics in order to provide long lasting perfume release on the laundered fabric. Disclosure of such compounds can be found in recently filed applications EP 98870227.0, EP 98870226.2, EP 99870026.4, and EP 99870025.6, all incorporated herein by reference.

Still, the above citations are limited to deposit only one or two type of perfume ingredients on the treated surfaces, whereas there is a need for a deposition of a more complete perfume formulation so that the various "aspects" of a perfume scent are represented, thereby increasing the consumer's acceptance.

Further, there is also a need for a process for making such composition that is economical and simple.

It has now been found that a laundry and/or cleaning composition which incorporates a benefit agent like a perfume composition with a carrier, wherein the carried composition has a viscosity of at least 400 cps, preferably 1.500 cps, more preferably 10.000 at 20° C. fulfills such a need.

Perfume which is combined with polymeric component is known in the art. Hence, JP-56075159 discloses the combination of methacrylonitrilebutadiene-styrene tertiary polymer with a liquid perfume so as to yield a semi-solid viscoelastic material for use in the adhesive industry. GB2141726 discloses perfumes which are mixed with adhesives glues for use in the adhesive industry to mask the odor of the adhesive. Finally, DE 3247709 discloses perfumed adhesive cardboard for paper package by using a polymer with a viscosity of 800 to 2500 mPa·s.

Perfume which is combined with solid carrier in laundry composition is also known in the art. Hence, WO 97/34982 uses zeolites particles as solid carrier, WO 94/19449 uses starch, whilst WO 98/28398 uses organic polymers.

Surprisingly, it has been found that when the combination of a benefit agent (e.g. perfume) with a carrier (e.g. polymer) is incorporated in a laundry and/or cleaning and/or fabric care product, the perfume composition is sufficiently protected from the wash oxidative solution and effectively deposited on the fabric whilst still providing efficient release of the perfume on the fabric, in particular dry fabric.

SUMMARY OF THE INVENTION

The present invention is a laundry and/or cleaning and/or fabric care composition comprising a detergent and/or cleaning and/or surfactant and/or fabric care ingredient and a benefit agent, said benefit agent being carried with a carrier, characterised in that the carried benefit agent has a viscosity of at least 400 cps at 20° C.

In another aspect of the invention, there is provided a process for the perfume composition.

Still in a further aspect of the invention, there is provided a method for providing an enhanced deposition of the benefit agent treated surfaces which comprises the steps of contacting the surface with a composition of the invention, or carried benefit agent as defined herein.

DETAILED DESCRIPTION OF THE INVENTION

Benefit Agent

The benefit agent is a component that will provide a beneficial effect on the treated surface like fabric. Hence, the benefit agent may be selected from a flavour ingredient, a pharmaceutical ingredient, a biocontrol ingredient, a perfume composition, a refreshing cooling ingredient and mixtures thereof.

Of course, various other features like the one you may want to deposit on the surface may be incorporated in this system, i.e. fabric softener, photobleaching agent, brightener, bleaching agents, enzymes, lubricants, bleach quenchers, anti-abrasion agents, crystal growth inhibitors, etc. . . .

Typically, the benefit agent comprises from 0.01 to 25%, more preferably from 0.02 to 10%, and most preferably from 0.05 to 5% by weight of the invention composition.

Flavour ingredients include spices, flavor enhancers that contribute to the overall flavour perception.

Pharmaceutical ingredients include drugs.

Biocontrol ingredients include biocides, antimicrobials, bactericides, bacteristatics, fungicides, algaecides, mildewcides, disinfectants, antiseptics, insecticides, vermicides, plant growth hormones.

Typical antimicrobials or antibacterials or bacteriostatics which can be carried by the carrier material include amine oxide surfactants, photo-activated bleaches, chlorhexidine diacetate, glutaraldehyde, cinnamon oil and cinnamaldehyde, citric acid, decanoic acid, lactic acid, maleic acid, nonanoic acid, polybiguanide, propylene glycol, cumene sulfonate, eugenol, thymol, benzalkonium chloride, geraniol, and mixtures thereof. Preferred are compounds which can react with the carrier material.

Preferably, the carrier material is a polymer, preferably a polymer which is reacted with another benefit agent, such as for example perfumes described herein, and this polymer or polymer reaction product functions as a carrier for the biocide. Preferred carried compositions for use in fabric care and cleaning compositions have a viscosity of at least 500 cps, or even at least 1000 cps, or even at least 10,000 cps or even more than 100,000 or even more than 500,000 cps, as described hereinafter. Preferred polymers are also described in more detail hereinafter.

Typical insect and/or moth repellants are perfume ingredients, such as citronellal, citral, N,N diethyl meta toluamide, Rotundial, 8-acetoxycarvotanacetone, ethyl-3-[N-butyl-N-acetyl-]aminoproprionate, allethrin, permethrin and mixtures thereof. Other examples of insect and/or moth repellant for use herein are disclosed in U.S. Pat. Nos. 4,449,987, 4,693,890, 4,696,676, 4,933,371, 5,030,660, 5,196,200, and "Semio Activity of Flavor and Fragrance molecules on various Insect Species", B. D. Mookherjee et al., published in *Bioactive Volatile Compounds from Plants*, ASC Symposium Series 525, R. Teranishi, R. G. Buttery, and H. Sugisawa, 1993, pp. 35-48.

One preferred benefit agent is a perfume composition.

Perfume Composition

Perfume compositions are typically comprised of one or a mixture of perfumes ingredients.

One typical perfume ingredient is a aldehyde perfume ingredient. Preferably, the perfume aldehyde is selected from adoxal; anisic aldehyde; cymal; ethyl vanillin; florhydral; helional; heliotropin; hydroxycitronellal; koavone; lauric aldehyde; lyral; methyl nonyl acetaldehyde; P. T. bucinal; phenyl acetaldehyde; undecylenic aldehyde; vanillin; 2,6,10-trimethyl-9-undecenal, 3-dodecen-1-al, alpha-n-amyl cinnamic aldehyde, 4-methoxybenzaldehyde, benzaldehyde, 3-(4-tert butylphenyl)-propanal, 2-methyl-3-(para-methoxyphenyl propanal, 2-methyl-4-(2,6,6-trimethyl-2(1)-cyclohexen-1-yl)butanal, 3-phenyl-2-propenal, cis-/trans-3,7-dimethyl-2,6-octadien-1-al, 3,7-dimethyl-6-octen-1-al, [(3,7-dimethyl-6-octenyl)oxy]acetaldehyde, 4-isopropylbenzyaldehyde, 1,2,3,4,5,6,7,8-octahydro-8,8-dimethyl-2-naphthaldehyde, 2,4-dimethyl-3-cyclohexen-1-carboxaldehyde, 2-methyl-3-(isopropylphenyl)propanal, 1-decanal; decyl aldehyde, 2,6-dimethyl-5-heptenal, 4-(tricyclo[5,2,1,0(2,6)]-decylidene-8)-butanal, octahydro-4,7-methano-1H-indenecarboxaldehyde, 3-ethoxy-4-hydroxy benzaldehyde, para-ethyl-alpha, alpha-dimethyl hydrocinnamaldehyde, alpha-methyl-3,4-(methylenedioxy)-hydrocinnamaldehyde, 3,4-methylenedioxybenzaldehyde, alpha-n-hexyl cinnamic aldehyde, m-cymene-7-carboxaldehyde, alpha-methyl phenyl acetaldehyde, 7-hydroxy-3,7-dimethyl octanal, Undecenal, 2,4,6-trimethyl-3-cyclohexene-1-carboxaldehyde, 4-(3)(4-methyl-3-pentenyl)-3-cyclohexen-carboxaldehyde, 1-dodecanal, 2,4-dimethyl cyclohexene-3-carboxaldehyde, 4-(4-hydroxy-4-methyl pentyl)-3-cylohexene-1-carboxaldehyde, 7-methoxy-3,7-dimethyloctan-1-al, 2-methyl undecanal, 2-methyl decanal, 1-nonanal, 1-octanal, 2,6,10-trimethyl-5,9-undecadienal, 2-methyl-3-(4-tertbutyl) propanal, dihydrocinnamic aldehyde, 1-methyl-4-(4-methyl-3-pentenyl)-3-cyclohexene-1-carboxaldehyde, 5 or 6 methoxyOhexahydro-4,7-methanoindan-1 or 2-carboxaldehyde, 3,7-dimethyloctan-1-al, 1-undecanal, 10-undecen-1-al, 4-hydroxy-3-methoxy benzaldehyde, 1-methyl-3-(4-methylpentyl)-3-cyclhexenecarboxaldehyde, 7-hydroxy-3,7-dimethyl-octanal, trans-4-decenal, 2,6-nonadienal, para-tolylacetaldehyde; 4-methylphenylacetaldehyde, 2-methyl-4-(2,6,6-trimethyl-1-cyclohexen-1-yl)-2-butenal, ortho-methoxycinnamic aldehyde, 3,5,6-trimethyl-3-cyclohexene carboxaldehyde, 3,7-dimethyl-2-methylene-6-octenal, phenoxyacetaldehyde, 5,9-dimethyl-4,8-decadienal, peony aldehyde (6,10-dimethyl-3-oxa-5,9-undecadien-1-al), hexahydro-4,7-methanoindan-1-carboxaldehyde, 2-methyl octanal, alpha-methyl-4-(1-methyl ethyl) benzene acetaldehyde, 6,6-dimethyl-2-norpinene-2-propionaldehyde, para methyl phenoxy acetaldehyde, 2-methyl-3-phenyl-2-propen-1-al, 3,5,5-trimethyl hexanal, Hexahydro-8,8-dimethyl-2-naphthaldehyde, 3-propyl-bicyclo[2.2.1]-hept-5-ene-2-carbaldehyde, 9-decenal, 3-methyl-5-phenyl-1-pentanal, methylnonyl acetaldehyde, 1-p-menthene-q-carboxaldehyde, citral, lilial, florhydral, mefloral, and mixtures thereof.

More preferred aldehydes are selected from citral, 1-decanal, benzaldehyde, florhydral, 2,4-dimethyl-3-cyclohexen-1-carboxaldehyde; cis/trans-3,7-dimethyl-2,6-octadien-1-al; heliotropin; 2,4,6-trimethyl-3-cyclohexene-1-carboxaldehyde; 2,6-nonadienal; alpha-n-amyl cinnamic aldehyde, alpha-n-hexyl cinnamic aldehyde, P.T. Bucinal, lyral, cymal, methyl nonyl acetaldehyde, trans-2-nonenal, lilial, trans-2-nonenal, lauric aldehyde, undecylenic aldehyde, mefloral and mixture thereof.

Another typical perfume ingredient is a ketone perfume ingredient. Preferably, the perfume ketone is selected from buccoxime; iso jasmone; methyl beta naphthyl ketone; musk indanone; tonalid/musk plus; Alpha-Damascone, Beta-Damascone, Delta-Damascone, Iso-Damascone, Damascenone, Damarose, Methyl-Dihydrojasmonate, Menthone, Carvone, Camphor, Fenchone, Alpha-Ionone, Beta-Ionone, Gamma-Methyl so-called Ionone, Fleuramone, Dihydrojasmone, Cis-Jasmone, Iso-E-Super, Methyl-Cedrenyl-ketone or Methyl-Cedrylone, Acetophenone, Methyl-Acetophenone, Para-Methoxy-Acetophenone, Methyl-Beta-Naphtyl-Ketone, Benzyl-Acetone, Benzophenone, Para-Hydroxy-Phenyl-Butanone, Celery Ketone or Livescone, 6-Isopropyldecahydro-2-naphtone, Dimethyl-Octenone, Freskomenthe, 4-(1-Ethoxyvinyl)-3,3,5,5,-tetramethyl-Cyclohexanone, Methyl-Heptenone, 2-(2-(4-Methyl-3-cyclohexen-1-yl)propyl)-cyclopentanone, 1-(p-Menthen-6(2)-yl)-1-propanone, 4-(4-Hydroxy-3-methoxyphenyl)-2-butanone, 2-Acetyl-3,3-Dimethyl-Norbornane, 6,7-Dihydro-1,1,2,3,3-Pentamethyl-4(5H)-Indanone, 4-Damascol, Dulcinyl or Cassione, Gelsone, Hexylon, Isocyclemone E, Methyl Cyclocitrone, Methyl-Lavender-Ketone, Orivon, Para-tertiary-Butyl-Cyclohexanone, Verdone, Delphone, Muscone, Neobutenone, Plicatone, Veloutone, 2,4,4,7-Tetramethyl-oct-6-en-3-one, Tetrameran, hedione, and mixtures thereof. The number of different perfume raw materials in the mixtures can be higher than 5, higher than 10 and even higher than 20.

More preferably, for the above mentioned compounds, the preferred ketones are selected from Alpha Damascone, Delta Damascone, Iso Damascone, Carvone, Gamma-Methyl-Ionone, Iso-E-Super, 2,4,4,7-Tetramethyl-oct-6-en-3-one, Benzyl Acetone, Beta Damascone, Damascenone, methyl dihydrojasmonate, methyl cedrylone, hedione, and mixtures thereof.

Still, the perfume composition may also be mixture of perfume ingredients including or not the above mentioned aldehyde or ketone.

Typical of these ingredients include fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

Suitable perfumes are disclosed in U.S. Pat. No. 5,500,138, said patent being incorporated herein by reference.

Examples of perfume ingredients useful in the perfume compositions include, but are not limited to, amyl salicylate; hexyl salicylate; terpineol; 3,7-dimethyl-cis-2,6-octadien-1-ol; 2,6-dimethyl-2-octanol; 2,6-dimethyl-7-octen-2-ol; 3,7-dimethyl-3-octanol; 3,7-dimethyl-trans-2,6-octadien-1-ol; 3,7-dimethyl-6-octen-1-ol; 3,7-dimethyl-1-octanol; 2-methyl-3-(para-tert-butylphenyl)-propionaldehyde; 4-(4-hydroxy-4-methylpentyl)-3-cyclohexene-1-carboxaldehyde; tricyclodecenyl propionate; tricyclodecenyl acetate; anisaldehyde; 2-methyl-2-(para-iso-propylphenyl)-propionaldehyde; ethyl-3-methyl-3-phenyl glycidate; 4-(para-hydroxyphenyl)-butan-2-one; 1-(2,6,6-trimethyl-2-cyclohexen-1-yl)-2-buten-1-one; para-methoxyacetophenone; para-methoxy-alpha-phenylpropene; methyl-2-n-hexyl-3-oxo-cyclopentane carboxylate; undecalactone gamma.

Additional examples of fragrance materials include, but are not limited to, orange oil; lemon oil; grapefruit oil; bergamot oil; clove oil; dodecalactone gamma; methyl-2-(2-pentyl-3-oxo-cyclopentyl) acetate; beta-naphthol methyl-ether; methyl-beta-naphthylketone; coumarin; 4-tert-butylcyclohexyl acetate; alpha, alpha-dimethylphenethyl acetate; methylphenylcarbinyl acetate; cyclic ethyleneglycol diester of tridecandioic acid; 3,7-dimethyl-2,6-octadiene-1-nitrile; ionone gamma methyl; ionone alpha; ionone beta; petitgrain; methyl cedrylone; 7-acetyl-1,2,3,4,5,6,7,8-octahydro-1,1,6,7-tetramethyl-naphthalene; ionone methyl; methyl-1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; benzophenone; 6-acetyl-1,1,2,3,3,5-hexamethyl indane; 5-acetyl-3-isopropyl-1,1,2,6-tetramethyl indane; 1-dodecanal; 7-hydroxy-3,7-dimethyl octanal; 10-undecen-1-al; iso-hexenyl cyclohexyl carboxaldehyde; formyl tricyclodecan; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; ambroxane; dodecahydro-3a,6,6,9a-tetramethylnaphtho-[2,1b]furan; cedrol; 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; cedryl acetate; para-tert-butylcyclohexyl acetate; patchouli; olibanum resinoid; labdanum; vetivert; copaiba balsam; fir balsam; hydroxycitronellal and indol; phenyl acetaldehyde and indol;

More examples of perfume components are geraniol; geranyl acetate; linalool; linalyl acetate; tetrahydrolinalool; citronellol; citronellyl acetate; dihydromyrcenol; dihydromyrcenyl acetate; tetrahydromyrcenol; terpinyl acetate; nopol; nopyl acetate; 2-phenylethanol; 2-phenylethyl acetate; benzyl alcohol; benzyl acetate; benzyl salicylate; benzyl benzoate; styrallyl acetate; dimethylbenzylcarbinol; trichloromethylphenylcarbinyl methylphenylcarbinyl acetate; isononyl acetate; vetiveryl acetate; vetiverol; 2-methyl-3-(p-tert-butylphenyl)-propanal; 2-methyl-3-(p-isopropylphenyl)-propanal; 3-(p-tert-butylphenyl)-propanal; 4-(4-methyl-3-pentenyl)-3-cyclohexenecarbaldehyde; 4-acetoxy-3-pentyltetrahydropyran; methyl dihydrojasmonate; 2-n-heptylcyclopentanone; 3-methyl-2-pentyl-cyclopentanone; n-decanal; n-dodecanal; 9-decenol-1; phenoxyethyl isobutyrate; phenylacetaldehyde dimethylacetal; phenylacetaldehyde diethylacetal; geranonitrile; citronellonitrile; cedryl acetal; 3-isocamphylcyclohexanol; cedryl methylether; isolongifolanone; aubepine nitrile; aubepine; heliotropine; eugenol; vanillin; diphenyl oxide; hydroxycitronellal ionones; methyl ionones; isomethyl ionomes; irones; cis-3-hexenol and esters thereof; indane musk fragrances; tetralin musk fragrances; isochroman musk fragrances; macrocyclic ketones; macrolactone musk fragrances; ethylene brassylate. Also suitable herein as perfume ingredients of the perfume composition are the so-called Schiff base. Schiff-Bases are the condensation of an aldehyde perfume ingredient with an anthranilate. A typical description can be found in U.S. Pat. No. 4,853,369. Typical of Schiff bases are selected from Schiffs base of 4-(4-hydroxy-4-methylpentyl)-3-cyclohexene-1-carboxaldehyde and methyl anthranilate; condensation products of: hydroxycitronellal and methyl anthranilate; 4-(4-hydroxy-4-methyl pentyl)-3-cyclohexene-1-carboxaldehyde and methyl anthranilate; Methyl Anthranilate and HydroxyCitronellal commercially available under the tradename Aurantiol; Methyl Anthranilate and Methyl Nonyl Acetaldehyde commercially available under the tradename Agrumea; Methyl Anthranilate and PT Bucinal commercially available under the tradename Verdantiol; Methyl anthranilate and Lyral commercially available under the tradename Lyrame; Methyl Anthranilate and Ligustral commercially available under the tradename Ligantral; and mixtures thereof.

Preferably, the perfume compositions useful in the present invention compositions are substantially free of halogenated materials and nitromusks.

More preferably, the perfume compounds are characterised by having a low Odor Detection Threshold. Such Odor Detection Threshold (ODT) should be lower than 1 ppm, preferably lower than 10 ppb—measured at controlled Gas Chromatography (GC) conditions such as described here below. This parameter refers to the value commonly used in the perfumery arts and which is the lowest concentration at which significant detection takes place that some odorous material is present. Please refer for example in "Compilation of Odor and Taste Threshold Value Data (ASTM DS 48 A)", edited by F. A. Fazzalari, International Business Machines, Hopwell Junction, N.Y. and in Calkin et al., Perfumery, Practice and Principles, John Willey & Sons, Inc., page 243 et seq (1994). For the purpose of the present invention, the Odor Detection Threshold is measured according to the following method:

The gas chromatograph is characterized to determine the exact volume of material injected by the syringe, the precise split ratio, and the hydrocarbon response using a hydrocarbon standard of known concentration and chain-length distribution. The air flow rate is accurately measured and, assuming the duration of a human inhalation to last 0.02 minutes, the sampled volume is calculated. Since the precise concentration at the detector at any point in time is known, the mass per volume inhaled is known and hence the concentration of material. To determine the ODT of a perfume material, solutions are delivered to the sniff port at the back-calculated concentration. A panelist sniffs the GC effluent and identifies the retention time when odor is noticed. The average over all panelists determines the threshold of noticeability. The necessary amount of analyte is injected onto the column to achieve a certain concentration, such as 10 ppb, at the detector. Typical gas chromatograph parameters for determining odor detection thresholds are listed below.

GC: 5890 Series II with FID detector
7673 Autosampler
Column: J&W Scientific DB-1
Length 30 meters ID 0.25 mm film thickness 1 micrometer
Method:
Split Injection: 17/1 split ratio
Autosampler: 1.13 microliters per injection
Column Flow: 1.10 mu/minute
Air Flow: 345 mL/minute
Inlet Temp. 245° C.
Detector Temp. 285° C.
Temperature Information
Initial Temperature: 50° C.
Rate: 5 C/minute
Final Temperature: 280° C.
Final Time: 6 minutes
Leading assumptions: 0.02 minutes per sniff
GC air adds to sample dilution Examples of such preferred perfume components are those selected from: 2-methyl-2-(para-iso-propylphenyl)-propionaldehyde, 1-(2,6,6-trimethyl-2-cyclohexan-1-yl)-2-buten-1-one and/or para-methoxy-acetophenone. Even more preferred are the following compounds having an ODT £10 ppb measured with the method described above: undecylenic aldehyde, undecalactone gamma, heliotropin, dodecalactone gamma, p-anisic aldehyde, para hydroxy-phenyl-butanone, cymal, benzyl acetone, ionone alpha, p.t.bucinal, damascenone, ionone beta, methyl-nonyl ketone, methyl heptine carbonate, linalool, indol, cis-3-hexenyl salicylate, vanillin, methyl isobutenyl tetrahydropyran, ethylvanillin, coumarin, ethyl methyl phenyl glycidate, eugenol, methylanthranilate, iso eugenol, beta naphtol methyl ester, herbavert, lyral, allyl amyl glycolate, dihydro iso jasmonate, ethyl-2-methylbutyrate, nerol, and phenylacetaldehyde. Most preferably the perfume composition comprises at least 5%, more preferably at least 10% of such components Most preferably, the perfume ingredients are those as described in WO 96/12785 on page 12-14. Even most preferred are those perfume compositions comprising at least 10%, preferably 25%, by weight of perfume ingredient with an ClogP of at least 2.0, preferably at least 3.0, and boiling point of at least 250° C. still another preferred perfume composition is a composition comprising at least 20%, preferably 35%, by weight of perfume ingredient with an ClogP at least 2.0, preferably at least 3.0, and boiling point of less than or equal to 250° C.

Clog P is a commonly known calculated measure as defined in the following references "Calculating log Poct from Structures"; Albert Leo (Medicinal Chemistry Project, Pomona College, Claremont, Calif. USA. Chemical Reviews, Vol. 93, number 4, June 1993; as well as from Comprehensive Medicinal Chemistry, Albert Leo, C. Hansch, Ed. Pergamon Press: Oxford, 1990, Vol. 4, p. 315; and Calculation Procedures for molecular lipophilicity: a comparative Study, Quant. Struct. Act. Realt. 15, 403-409 (1996), Raymund Mannhold and Karl Dross.

Carrier

A carrier is another essential component of the invention. Indeed, the carrier will serve for the deposition of the benefit agent onto the surface as well as protecting the benefit agent from oxidation from the wash liquor as well as from diffusing in the aqueous environment.

Preferably, for the purpose of the invention, the carrier or even the carried composition is water-insoluble, preferably the carrier is a water-insoluble polymer. Carrier to be used herein are selected from polymers which have chemically reacted with a benefit agent like perfume ingredient, components which have chemically reacted with a benefit agent like perfume ingredient to make the carrier as above mentioned, polymers which are not capable of chemically reacting with a benefit agent like a perfume ingredient above mentioned, i.e. chemically inert, and mixtures thereof.

These carrier components are selected so as to provide the required viscosity of at least 400 cps for the resulting carried composition. Preferably, these components will also provide the water-insolubility of the carried composition.

In the present invention, if using polymers as the carrier and aldehyde mixtures as the benefit agent, it is possible to adjust the ratio of the carrier and the benefit agent. If the amount of polymers are low, some aldehydes remain unreacted. In this case, these unreacted-aldehydes can also perform as perfume in the final product in the present invention.

a)—Compounds which have Chemically Reacted with a Benefit Agent

Examples of compounds which have chemically reacted with a benefit agent are the so-called "amines which form amine reaction products", i.e. a product of reaction between a compound containing a primary amine functional group and/or secondary amine functional group and an active ketone or aldehyde containing component. Preferred compounds for use herein are polymers which have been previously reacted with an aldehyde and/or ketone perfume ingredient, thereby imparting a more effective scent to the fabrics.

A typical disclosure of amine reaction product suitable for use herein can be found in recently filed applications EP 98870227.0, EP 98870226.2, EP 99870026.4, and EP 99870025.6, all incorporated herein by reference.

A—Primary Amine and/or Secondary Amine

By "primary and/or secondary amine", it is meant a component which carries at least one primary and/or secondary amine and/or amide function.

Of course, one amine compound may carry both primary and secondary amine compound, thereby enabling the reaction with several aldehydes and/or ketones.

Preferably, the primary amine and/or secondary amine compound is also characterized by an Odour Intensity Index of less than that of a 1% solution of methylanthranilate in dipropylene glycol.

Odour Intensity Index Method

By Odour Intensity Index, it meant that the pure chemicals were diluted at 1% in Dipropylene Glycol, odor-free solvent used in perfumery. This percentage is more representative of usage levels. Smelling strips, or so called "blotters", were dipped and presented to the expert panellist for evaluation. Expert panellists are assessors trained for at least six months in odor grading and whose gradings are checked for accuracy and reproducibility versus a reference on an on-going basis.

For each amine compound, the panellist was presented two blotters: one reference (Me Anthranilate, unknown from the panellist) and the sample. The panellist was asked to rank both smelling strips on the 0-5 odor intensity scale, 0 being no odor detected, 5 being very strong odor present.

Results:

The following represents Odour Intensity Index of an amine compound suitable for use in the present invention and according to the above procedure. In each case, numbers are arithmetic averages among 5 expert panellists and the results are statistically significantly different at 95% confidence level:

| | |
|---|---|
| Methylanthranilate 1% (reference) | 3.4 |
| Ethyl-4-aminobenzoate (EAB) 1% | 0.9 |
| 1,4-bis-(3-aminopropyl)-piperazine (BNPP) 1% | 1.0 |

A general structure for the primary amine compound of the invention is as follows:

$$B—(NH2)_n;$$

wherein B is a carrier material, and n is an index of value of at least 1.

Compounds containing a secondary amine group have a structure similar to the above excepted that the compound comprises one or more —NH— groups instead of —NH2. Further, the compound structure may also have one or more of both —NH2 and —NH— groups.

Preferred B carriers are inorganic or organic carriers.

By "inorganic carrier", it is meant carrier which are non-or substantially non carbon based backbones.

Preferred primary and/or secondary amines, among the inorganic carriers, are those selected from mono or polymers or organic-organosilicon copolymers of amino derivatised organo silane, siloxane, silazane, alumane, aluminum siloxane, or aluminum silicate compounds. Typical examples of such carriers are: organosiloxanes with at least one primary amine moiety like the diaminoalkylsiloxane [H2NCH2(CH3)2Si]O, or the organoaminosilane (C6H5) 3SiNH2 described in: Chemistry and Technology of Silicone, W. Noll, Academic Press Inc. 1998, London, pp 209, 106).

Preferred primary and/or secondary amines, among the organic carriers, are those selected from aminoaryl derivatives, polyamines, amino acids and derivatives thereof, substituted amines and amides, glucamines, dendrimers, polyvinylamines and derivatives thereof, and/or copolymer thereof, alkylene polyamine, polyaminoacid and copolymer thereof, cross-linked polyaminoacids, amino substituted polyvinylalcohol, polyoxyethylene bis amine or bis aminoalkyl, aminoalkyl piperazine and derivatives thereof, bis(amino alkyl) alkyl diamine linear or branched, and mixtures thereof.

Preferred aminoaryl derivatives are the amino-benzene derivatives including the alkyl esters of 4-amino benzoate compounds, and more preferably selected from ethyl-4-amino benzoate, phenylethyl-4-aminobenzoate, phenyl-4-aminobenzoate, 4-amino-N'-(3-aminopropyl)-benzamide, and mixtures thereof.

Polyamines suitable for use in the present invention are polyethyleneimines polymers, poly[oxy(methyl-1,2-ethanediyl)], α-(2-aminomethylethyl)-ω-(2-aminomethylethoxy)-(=C.A.S No. 9046-10-0); poly[oxy(methyl-1,2-ethanediyl)], α-hydro-)-ω-(2-aminomethylethoxy)-, ether with 2-ethyl-2-(hydroxymethyl)-1,3-propanediol (=C.A.S, No. 39423-51-3); commercially available under the tradename Jeffamines T-403, D-230, D-400, D-2000; 2,2',2"-triaminotriethylamine; 2,2'-diamino-diethylamine; 3,3'-diamino-dipropylamine, 1,3 bis aminoethyl-cyclohexane commercially available from Mitsubishi and the C12 Sternamines commercially available from Clariant like the C12 Sternamin(propylenamine)$_n$ with n=¾, and mixtures thereof. Preferred polyamines are polyethyleneimines commercially available under the tradename Lupasol like Lupasol HF (MW 25000), P (MW 750000), PS (MW 750000), SK (MW 2000000), SNA (MW 1000000), G20 (MW1300), G35 (MW2000), G100, PR8515 (MW2000), FG (MW800).

Preferred amino acids for use herein are selected from tyrosine, tryptophane, lysine, glutamic acid, glutamine, aspartic acid, arginine, asparagine, phenylalanine, proline, glycine, serine, histidine, threonine, methionine, and mixture thereof, most preferably selected from tyrosine, tryptophane, and mixture thereof. Preferred amino acid derivatives are selected from tyrosine ethylate, glycine methylate, tryptophane ethylate, and mixture thereof.

Preferred substituted amines and amides for use herein are selected from nipecotamide, N-coco-1,3-propenediamine; N-oleyl-1,3-propenediamine; N-(tallow alkyl)-1,3-propenediamine; 1,4-diamino cyclohexane; 1,2-diamino-cyclohexane; 1,12-diaminododecane, and mixtures thereof.

Other primary amine compounds suitable for use herein are the glucamines, preferably selected from 2,3,4,5,6-pentamethoxy-glucamine; 6-acetylglucamine, glucamine, and mixture thereof.

Also preferred compounds are the polyethylenimine and/or polypropylenimine dendrimers and the commercially available Starburst® polyamidoamines (PAMAM) dendrimers, generation GO-G10 from Dendritech and the dendrimers Astromols3, generation 1-5 from DSM being DiAminoButane PolyAmine DAB (PA)x dendrimers with x=2$^n$×4 and n being generally comprised between 0 and 4.

Polyamino acid is one suitable and preferred class of amino-functional polymer. Polyaminoacids are compounds which are made up of amino acids or chemically modified amino acids. They can contain alanine, serine, aspartic acid, arginine, valine, threonine, glutamic acid, leucine, cysteine, histidine, lysine, isoleucine, tyrosine, asparagine, methionine, proline, tryptophan, phenylalanine, glutamine, glycine or mixtures thereof. In chemically modified amino acids, the amine or acidic function of the amino acid has reacted with a chemical reagent. This is often done to protect these chemical amine and acid functions of the amino acid in a subsequent reaction or to give special properties to the amino acids, like improved solubility. Examples of such chemical modifications are benzyloxycarbonyl, aminobutyric acid, butyl ester, pyroglutamic acid. More examples of common modifications of amino acids and small amino acid fragments can be found in the Bachem, 1996, Peptides and Biochemicals Catalog.

Preferred polyamino acids are polylysines, polyarginine, polyglutamine, polyasparagine, polyhistidine, polytryptophane or mixtures thereof. Most preferred are polylysines or polyamino acids where more than 50% of the amino acids are lysine, since the primary amine function in the side chain of the lysine is the most reactive amine of all amino acids.

The preferred polyamino acid has a molecular weight of 500 to 10,000,000, more preferably between 2,000 and 25,000.

The polyamino acid can be cross linked. The cross linking can be obtained for example by condensation of the amine group in the side chain of the amino acid like lysine with the carboxyl function on the amino acid or with protein cross linkers like PEG derivatives. Other examples are described herein below. The cross linked polyamino acids still need to have free primary and/or secondary amino groups left for reaction with the active ingredient.

The preferred cross linked polyamino acid has a molecular weight of 20,000 to 10,000,000, more preferably between 200,000 and 2,000,000.

The polyamino acid or the amino acid can be co-polymerized with other reagents like for instance with acids, amides, acyl chlorides. More specifically with aminocaproic acid, adipic acid, ethylhexanoic acid, caprolactam or mixture thereof. The molar ratio used in these copolymers ranges from 1:1 (reagent/amino acid (lysine)) to 1:20, more preferably from 1:1 to 1:10.

The polyamino acid like polylysine can also be partially ethoxylated.

Examples and supply of polyaminoacids containing lysine, arginine, glutamine, asparagine are given in the Bachem 1996, Peptides and Biochemicals catalog.

The polyaminoacid can be obtained before reaction with the active ingredient, under a salt form. For example polylysine can be supplied as polylysine hydrobromide. Polylysine hydrobromide is commercially available from Sigma, Applichem, Bachem and Fluka.

Examples of suitable amino functional polymers containing at least one primary and/or secondary amine group for the purpose of the present invention are:

- Polyvinylamine with a MW of about 300-2.10E6;
- Polyvinylamine alkoxylated with a MW of about 600, 1200 or 3000 and an ethoxylation degree of 0.5;
- Polyvinylamine vinylalcohol—molar ratio 2:1, polyvinylaminevinylformamide—molar ratio 1:2 and polyvinylamine vinylformamide-molar ratio 2:1;
- Triethylenetetramine, diethylenetriamine, tetraethylenepentamine;
- Bis-aminopropylpiperazine;
- Polyamino acid (L-lysine/lauric acid in a molar ratio of 10/1), Polyamino acid (L-lysine/aminocaproic acid/adipic acid in a molar ratio of 5/5/1), Polyamino acid (L-lysine/aminocaproic acid/ethylhexanoic acid in a molar ratio of 5/3/1) Polyamino acid (polylysine-cocaprolactam); Polylysine; Polylysine hydrobromide; cross-linked polylysine,
- amino substituted polyvinylalcohol with a MW ranging from 400-300,000;
- polyoxyethylene bis[amine] available from e.g. Sigma;
- polyoxyethylene bis[6-aminohexyl] available from e.g. Sigma;
- N,N'-bis-(3-aminopropyl)-1,3-propanediamine linear or branched (TPTA); and
- 1,4-bis-(3-aminopropyl) piperazine (BNPP).

The more preferred compounds are selected from ethyl-4-amino benzoate, polyethyleneimine polymers commercially available under the tradename Lupasol like Lupasol WFG20 waterfree, PR8515, HF, P, PS, SK, SNA; the diaminobutane dendrimers Astramol®, polylysine, cross-linked polylysine, N,N'-bis-(3-aminopropyl)-1,3-propanediamine linear or branched; 1,4-bis-(3-aminopropyl) piperazine, and mixtures thereof. Even most preferred compounds are those selected from ethyl-4-amino benzoate, polyethyleneimine polymers commercially available under the tradename Lupasol like Lupasol WF, G20 waterfree, PR8515, HF, P, PS, SK, SNA; polylysine, cross-linked polylysine, N,N'-bis-(3-aminopropyl)-1,3-propanediamine linear or branched, 1,4-bis-(3-aminopropyl) piperazine, and mixtures thereof.

Advantageously, such most preferred primary and/or secondary amine compounds also provide fabric appearance benefit, in particular colour appearance benefit, thus providing a resulting amine reaction product with the properties of fabric appearance benefit, deposition onto the surface to be treated, and delayed release of the active as well as release of the perfume composition. Further, when the primary and/or secondary amine compound has more than one free primary and/or secondary amine group, several different active ingredients (aldehyde and/or ketone) can be linked to the amine compound.

Of course, the primary and/or secondary amine compound may also be used as is, i.e. without having been reacted with the above benefit agent like aldehyde and/or ketone perfume ingredient. Moreover, the primary and/or secondary amine compound may also be reacted with compounds other than the benefit agent mentioned above like acyl halides, like acetylchloride, palmytoyl chloride or myristoyl chloride, acid anhydrides like acetic anhydride, alkylhalides or arylhalides to do alkylation or arylation, aldehydes or ketones not used as perfume ingredients like formaldehyde, glutaraldehyde, unsaturated ketones, aldehydes or carboxylic acids like 2-decylpropenoic acid, propenal, propenone to form reaction products with the required viscosity.

The carrier mix can be treated (during the mix is formed or after) with plasticisers like phtalates, with tactifiers like rosin acids or rosin esters, cross-linking agents like bifunctional aldehydes, or with thickeners, as described herein after. These agents can give the polymer the proper carrier characteristics like the required viscosity if the viscosity is not high enough. Of course, other known viscosity enhancer may be used herein for that purpose. Preferably the ratio of carried benefit agent to thickening and/or cross-linking agent being from 100:1 to 10:1.

b)—Polymers which are not Capable of Chemically Reacting with a Benefit Agent

Polymers which are not capable of chemically reacting with a benefit agent include block copolymers like block copolymer of styrene and butadiene, polyisoprene, polyacrylate, acrylic emulsion polymers using preferably ethylacrylate butyl acrylate, 2-ethylhexylacrylate, methylacrylate, acrylic acid, methacrylic acid as monomers, acrylic emulsion polymers copylymerized with vinyl acetate, vinyl chloride or maleic acid, styrene polymers, polyurethane, polybutadiene, polyepichlorohydrin, neoprene or chloroprene, natural latex rubbers, polyvinylpyrrolidine, polyvinylpyridine N oxide, vinylpyrrolodone vinyl imidazole copolymer, chlorosulfonyl polyethylene, ethylene propylene copolymer, ethylene polysulfide, polyvinylacetate, polyamide, polyvinylacetate-ethylene copolymers, urea-formaldehyde resins, cyanoacrylates, polysulphides, polyvinylalcohol, styrene-butadiene polymers, polyolefines based on polyethylene or polypropylene, polyester, nitrile rubber polymers based on butadiene and acrylonitrile, as well as silicone rubbers having methyl, phenyl and vinyl groups or mixtures thereof or copolymers (random, block or grafted) of the above mentioned polymers or the above polymers further cross linked with cross linking agents like zinc oxide.

The polymers can be treated with plasticisers like phtalates, with tactifiers like rosin acids or rosin esters, or with thickeners. These agents can give the polymer the proper carrier characteristics like the required viscosity.

Preferred polymers from this class are polymers used in the adhesive industry, more preferably polyisobutylene polymers supplied by BASF under the commercial name of Oppanol.

It is most preferred that the benefit agent and the carrier are present in weight ratios of from 0.05:1 to 5:1, preferably of from 1:1 to 4:1. Indeed, not to be bound by theory, it is speculated that below a ratio of 0.05:1 or even 0.5:1, the amount of polymer that would be required to form the carried composition would be too high while above a ratio of 5:1, the system would be too liquid and therefore not provide its purpose of deposition onto the treated surface.

Viscosity

Viscosity of the carried perfume composition, i.e. the perfume composition which is carried by the carrier material, is an essential feature of the invention. Indeed, with the viscosity characteristic, the perfume composition is ensured to be protected from its oxidative environment present in the wash liquour, effectively deposited on the surface to be treated and thereafter to deliver its release on the treated surface.

To achieve these benefits, the viscosity of the carried composition is between 400 cps, preferably between 1,500 cps and 100,000,000 cps, preferably between 5,000 and 10,000,000 cps, more preferably between 10,000 and 1,000,000 cps, most preferably between 10,000 and 100,000

The viscosity is measured on a rheometer, TA Instrument $CSL^2{}_{100}$ at a temperature of 20 C. with a gap setting of 500 micrometers.

Process

The carried composition comprising the benefit agent is obtained by mixing the benefit agent with the carrier in such a way that a very viscous homogeneous fluid is obtained with the desired viscosity.

One convenient way for making the carried composition in industrial quantities is via a continuous process like by means of a twin Screw Extruder (TSE). Suitable TSE include the TX-57 MAG, TX-85 MAG, TX-110 MAG, TX-144 MAG, or TX-178 MAG twin screw extruder from Wenger. One preferred for use herein is the TX-57 MAG. TSE suitable for use herein comprise at one of their extremities so called herein after "first part of the TSE" two distinct inlet: one for the active and the other for the amine, and at about the middle of the TSE, so called hereinafter "second part of the TSE" another inlet for the carrier. Temperature controllers are also distributed along the TSE.

Preferred is that the carried composition is made into suspendable particels or solid particles by dispersing it into a carrier dispersing agent (or below referred to as 'carrier'), preferrably a liquid carrier, which is preferably a material which is solid at room temperature, e.g. below 25° C. or even below 30° C., and is liquid due to the temperature of the equipment wherein the mixing takes place and/or the temperature of the product or mixture of step a). Thus, the carrier material has preferably a melting point above 30° C. Preferably, the temperature of the product of step a) and/or the carrier material is such that the carrier material is in its molten state, preferably the temperature of the carrier material and/or the reaction product/mixture of step a) is between 30° C. and 100° C., preferably between 40° C. and 80° C. or even between 50° C. and 80° C. Preferably, for the purpose of the invention, when the resulting carried composition is to be a suspendable material, the carrier also has a viscosity from 500 or even from 700 to 100,000 or even 70,000 cps.

Highly preferred are carrier materials which do not react with the carried composition of the invention.

Highly preferred are organic nonionic material, including nonionic surfactants. Preferred carrier material include liquids conventionally used in cleaning products as solvents, such as alcohols, glycerols.

Preferred are nonionic surfactants. Essentially any nonionic surfactants useful for detersive purposes can be included in the compositions provided it has a melting point between 30° C. and 135° C.

Exemplary, non-limiting classes of useful nonionic surfactants are:

Polyhydroxy fatty acid amides suitable for use herein are those having the structural formula R2CONR1Z wherein: R1 is H, $C_1$-$C_4$ hydrocarbyl, 2-hydroxy ethyl, 2-hydroxy propyl, or a mixture thereof, preferable $C_1$-$C_4$ alkyl, more preferably $C_1$ or $C_2$ alkyl, most preferably $C_1$ alkyl (i.e., methyl); and R2 is a $C_5$-$C_{31}$ hydrocarbyl, preferably straight-chain $C_5$-$C_{19}$ alkyl or alkenyl, more preferably straight-chain $C_9$-$C_{17}$ alkyl or alkenyl, most preferably straight-chain $C_{11}$-$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

The alkyl ethoxylate condensation products of aliphatic alcohols with from about 1 to about 150 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 25 to about 150 moles of ethylene oxide per mole of alcohol, preferably 50 to 100, more preferably 80 moles of ethylene oxide per mole of alcohol.

Preferred nonionic ethoxylated alcohol surfactants are selected from tallow ($C_{16}$-$C_{18}$) alcohol ethoxylated with 25, 50, 80, or 100 moles of ethylene oxide commercially available from under the tradename of Lutensol from BASF, Empilan from Albright and Wilson, and Genapol from Clariant. The most preferred nonionic ethoxylated alcohol surfactant is tallow ($C_{16}$-$C_{18}$) alcohol ethoxylated with 80 moles of ethylene oxide and commercially available under the tradename of Lutensol 80/80 from BASF, Empilan KM 80 from Albright and Wilson, or Genapol T800 from Clariant.

The ethoxylated $C_6$-$C_{22}$ fatty alcohols and $C_6$-$C_{22}$ mixed ethoxylated/propoxylated fatty alcohols are suitable surfactants for use herein, particularly where water soluble. Preferably the ethoxylated fatty alcohols are the $C_{10}$-$C_{22}$ ethoxylated fatty alcohols with a degree of ethoxylation of from 25 to 150, most preferably these are the $C_{12}$-$C_{18}$ ethoxylated fatty alcohols with a degree of ethoxylation from 50 to 80. Preferably the mixed ethoxylated/propoxylated fatty alcohols have an alkyl chain length of from 10 to 18 carbon atoms, a degree of ethoxylation of from 3 to 30 and a degree of propoxylation of from 1 to 30.

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™ surfactants, marketed by BASF.

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available Tetronic™ compounds, marketed by BASF.

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

The preferred alkylpolyglycosides have the formula $$R2O((CnH2n)O)t(glycosyl)_X$$

wherein R2 is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3; t is from 0 to 10, preferably 0, and X is from 1.3 to 8, preferably from 1.3 to 3, most preferably from 1.3 to 2.7. The glycosyl is preferably derived from glucose.

Fatty acid amide surfactants suitable for use herein are those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$-$C_4$ alkyl, $C_1$-$C_4$ hydroxyalkyl, and —$(C_2H_4O)_x$H, where x is in the range of from 1 to 3.

Preferred carrier materials are selected from nonionic ethoxylated alcohol surfactants, polyalkoxylated compounds, such as polyalkoxylated esters, polyalkoxylated amines, polyalkoxylated amides, polyalkoxylated alcohols, preferably poly ethoxylated compounds. Preferred average alkoxylation degrees are at least 25, or even at least 40 or even at least 70. Also useful herein as carrier are quaternary oligoamine oligomers, preferably alkoxylated quaternary oligoamines, more preferable polyethoxylated quaternary diamines, preferably having an alkoxylation degree of 10 to 40, or even 16 to 26, preferably the quaternary amine groups being spaced apart by 2 carbon atoms or more, preferably by 4 carbon atoms or more, pr even at 6 or more carbon atoms, preferably this being alkylene moieties.

Highly preferred carrier materials include polyalkoxylated alcohols. Tallow alcohol polyethoxylates, such as TAE80, and PEG and cationically modified PEG are preferred examples. Also preferred are polyethylene glycols, preferably with an weight average molecular weight of more than 400, preferably more than 1000 or even more than 2000 or even more than 3000, for example PEG 4000, preferably up to 10,000.

Also useful as carrier can be anionic surfactants, cationic surfactants, amphoteric surfactants, zwitterionic surfactants and/or amphiphilic surfactants.

Also useful are hydrotropes, such as salts (sodium) of xylenen sulphonate, toluene sulphonate and/or cumene sulphonate.

Other preferred carriers include silicone materials. Preferred are non-volatile silicone fluids such as polydimethyl siloxane gums and fluids, such as linear silicone polymer fluids having the formula $(CH_3)3SiO[(CH3)2SiO]mSi(CH)3$ where m is 0 or more and whereby m has an average value such that the viscosity at 25° C. of the silicone fluid is preferably 5 centistokes or more, more preferably 500 centistokes or more, the silicone fluid preferably having a weight average molecular weight of 800 or more, preferably 25,000 or more; or such as volatile silicone fluid which can be a cyclic silicone fluid of the formula [(CH3)2SiO]n where n ranges between about 3 to about 7, preferably about 5 or 6; or such as silicone surfactants, such as silicone-glycolethers; other suitable silicone surfactants are described in 'Silicone Surfactants', by R. M. Hill, ISBN 0-8247-0010-4, 1999, Marcel Dekker Inc. NewYork, Base1. These silicone surfactants can be ABA type copolymers, grafted copolymers or ter- or tri-siloxane polymers. The silicone surfactants can be silicone polyether copolymers and can have ethylene oxide, propylene oxide or butylene oxide based chains and/or mixtures thereof. More preferably the silicone surfactant has a weight average molecular weight of more than 1000, more preferably more than 5000. The silicone or silicone surfactants can be a fluorosilicone as well, preferably a fluorosilicone with a viscosity of at least 1000 cps.

Suitable examples of silicone for use herein as carrier include silicones commercially available from Dow Corning Corporation like the DC 3225 C; DC5225 C and DC246 for cyclic silicones; silicone glycols ethers like DC5200, DC1248, DC190; the DC 244 Fluids, DC 245 Fluids, DC 344 Fluids, or DC 345 Fluids, or ABIL K4, ABIL B 8839 for the cyclomethicone, or the DC 200 fluids, ABIL K 520 (hexamethyl disiloxane), ABIL 10 to ABIL 100000 (dimethicone), ABIL AV 8853 (Phenyl dimethicone) for the linear silicones; Dow Corning's FS1265 fluorosilicones.

Still another suitable carrier is a combination of various silicone materials and/or other carriers, such as those described herein before. Preferably, one or more silicone material(s) is (are) emulsified or microemulsified in one or more other silicone materials. Preferably, at least 80% or even 90% of such a silicone mixture is formed by 2 silicone materials. Then, the weight ratio of a first silicone material to a second silicone material in such a mixture is preferably from 1:50 to 2:1, more preferably 1:19 to 3:2, or even 1:9 to 1:1. Preferably, the carrier for suspendable components formed by the process herein is selected from glycols and/or silicones, described above, most preferably is selected from silicones. Preferably, the carrier for solid components formed by the process herein is selected from nonionic surfactants, alkoxylated compounds, including alkoxylated alcohol nonionic surfactants, alcohols, glycols and/or (polyalkylene) glycols.

When solid compositions are preferred, a solid granulation agent is preferably added to the carried composition or the carried composition which is mixed with the carriers described above. The solid granulation aid can be any material which is solid under the reaction conditions, other than the compounds reacted with another. Preferred are inorganic or organic acids or salts. The granulation agent should be such that it does not react with the reaction product of step a). Preferred are anhydrous materials.

Highly preferred are solid granulation agents in powder form having a weight mean particle size of from 1 to 200 microns, preferably up to 150 microns or even up to 100 microns.

Preferred are organic carboxylic acid or salts thereof, conventional chelating agents, including phosphonate chelating agents are suitable herein, or preferred are inorganic materials such as inorganic salts, including bicarbonates, carbonates, sulphates, phosphates, amorphous and crystalline (layered) silicates, including aluminosilicates. Preferred salts are salts of sodium, potassium or magnesium. Highly preferred is the use of at least a carbonate salt or an aluminosilicate or mixtures thereof.

Suitable water-soluble solid granulation agents as organic acid carriers include monocarboxylic acids, monomeric polycarboxylic acids, homo or copolymeric polycarboxylic acids, inorganic acids, and mixtures thereof.

Suitable example of monocarboxylic acids containing one carboxy group include formic acid, acetic acid, propionic acid, butyric acid, valeric acid, caproic acid, enanthic acid, caprylic acid, pelargonic acid, capric acid, lauric acid, myristic acid, palmitic acid, stearic acid, and mixtures thereof.

Still other suitable monocarboxylic acids are the monocarboxylic acids substituted by any of the following groups: CH3— (CH2)n, wherein n is an integer of value of at least 1, CH3, OH, NH2, Cl, Br, F, I, OR", NHR", NR"2, NO2, SO3, cyclic rings like cyclopentane, cyclohexane, phenyl, benzyl, or a mixture of these substituents; wherein R" is selected from saturated or unsaturated alkyl chains. Preferred examples are 1-methylcyclohexanecarboxylic acid, glycolic acid, mandelic acid, lactic acid, salicylic acid, benzoic acid, and derivatives thereof. The substituents may also be anywhere in the alkyl chain attached to the acidic function. The alkyl chain can be saturated or non saturated.

Other dicarboxylic acids suitable for use herein are the dicarboxylic acids substituted by CH3—(CH2)n, wherein n is an integer of value of at least 1, CH3, OH, NH2, Cl, Br, F, I, OR", NHR", NR"2, NO2, SO3, cyclic rings like cyclopentane, cyclohexane, phenyl, benzyl, or a mixture of these substituents; wherein R" is selected from saturated or unsaturated alkyl chain. Preferred examples of such substituted dicarboxylic acids are phtalic acid, isophtalic acid, terephtalic acid, malic acid, fumaric acid, tartaric acid, or mixtures thereof. The substituents may also be anywhere in the alkyl chain attached to the acidic functions. The alkyl chains can be saturated or non saturated.

Other polycarboxylic acids suitable for use herein are the polycarboxylic acids containing three carboxy groups and include, in particular, water-soluble citric acid, aconitric and citraconic acid as well as succinic derivatives such as the carboxymethyloxysuccinic described in British Patent No. 1,379,241, lactoxysuccinic described in British Patent No. 1,389,732, and aminosuccinic described in Netherlands Application 7205873, and the oxypolycarboxylic materials such as 2-oxa-1,1,3-propane tricarboxylic described in British Patent No. 1,387,447.

Other polycarboxylic acids suitable for use herein are the polycarboxylic acids containing four carboxy groups and include oxydisuccinic disclosed in British Patent No. 1,261,829, 1,1,2,2-ethane tetracarboxylic, 1,1,3,3-propane tetracarboxylic and 1,1,2,3-propane tetracarboxylic. Polycarboxylic containing sulfo substituents include the sulfosuccinic derivatives disclosed in British Patent Nos. 1,398,421 and 1,398,422 and in U.S. Pat. No. 3,936,448, and the sulfonated pyrolysed citratic described in British Patent No. 1,439,000.

Other suitable granulation agents are amino acids like, glycine, lysine, alanine, valine, leucine, isoleucine, proline, phenylalanine, tyrosine, tryptophan, serine, threonine, cysteine, methionine, asparagine, glutamine, aspartate, glutamate, arginine, histidine, and mixtures thereof.

Other suitable solid granulation agents are acid anhydrides and acyl halides. Acid anhydrides react in the presence of water to acids. Sometimes, the production of the amine reaction product is followed by the incomplete removal of the water in the amine samples. It may then be desired to remove the remaining water by reacting it with the acid anhydrides to form acids which in turn make the salt with the amine reaction product.

Preferably, to avoid possible hydrolysis of the product in-situ due to the eventual additional water coming from the acid carrier, the acid carrier is used in its anhydrous forms. For example, citric acid is available under anhydrous form or as a monohydrate.

Of the above, the preferred are polycarboxylic acids selected from citric acid, tartaric acid, malonic acid, succinic acid, oxalic acid, crotonic acid, adipic acid, maleic acid, malic acid, phtalic acid, succinic acid, hydroxysuccinic acid, polyacrylic acid, and mixtures thereof.

Preferred are also mixtures of granulation agents, for examples mixtures of inorganic salts or mixtures of organic acids and inorganic salts, including effervescing mixtures such as carboxylic acids and (bi)carbonates.

Suitable organic polymeric compounds suitable as solid granulation agents include cellulose derivatives such as methylcellulose, carboxymethylcellulose, hydroxypropylcellulose and hydroxyethylcellulose, as well as carbohydrates like pectins, and gums. Further compounds are carbohydrates and derivatives such as fructose, xylose, galactose, galacturonic acid or glucose based polymers like inuline, dextran, xyloglucan, pectin or gums Examples of carbonates are the alkaline earth and alkali metal carbonates, including sodium carbonate and sesquicarbonate and mixtures thereof with ultra-fine calcium carbonate as disclosed in German Patent Application No. 2,321,001 published on Nov. 15, 1973.

Specific examples of water-soluble phosphates are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Typical disclosure of cyclodextrin derivatives are disclosed in WO96/05358, U.S. Pat. No. 3,426,011, Parmerter et al., issued Feb. 4, 1969; U.S. Pat. Nos. 3,453,257; 3,453,258; 3,453,259; and 3,453,260, all in the names of Parmerter et al., and all issued Jul. 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,678,598, Ogino et al., issued Jul. 7, 1987; U.S. Pat. No. 4,638,058, Brandt et al., issued Jan. 20, 1987; and U.S. Pat. No. 4,746,734, Tsuchiyama et al., issued May 24, 1988; all of said patents being incorporated herein by reference.

Although less preferred for use herein because of their lower solubility, the solid granulation agents may also comprise silicates and aluminosilicates.

Suitable silicates include the water soluble sodium silicates with an $SiO_2$:$Na_2$0 ratio of from 1.0 to 2.8, with ratios of from 1.6 to 2.4 being preferred, and 2.0 ratio being most preferred. The silicates may be in the form of either the anhydrous salt or a hydrated salt. Sodium silicate with an $SiO_2$:$Na_2$0 ratio of 2.0 is the most preferred silicate.

Crystalline layered sodium silicates have the general formula $$NaMSi_x0_{x+1,y}H_20$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4 and is preferably 2. The most preferred material is δ-$Na_2Si_2O_5$, available from Hoechst AG as NaSKS-6.

Suitable aluminosilicate zeolites have the unit cell formula $Na_{z[(AlO2)_z}(SiO_2)y]$. $XH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

Typically when the amine reaction product is mixed with a solid granulation agent and further processed to form a particle, the amine reaction product will be present in an amount of from 1 to 75%, preferably 5 to 30%, more preferably 6 to 25% by weight of the processed reaction product in the produced particle.

Typically the granulation agent will be present in an amount of from 10% to 95%, preferably from 30 to 90%, more preferably, 50 to 75% by weight of the resulting granule.

One method for applying mixing with the solid granulation agent involves agglomeration. Any conventional agglomerator/mixer may be used including, but not limited to pan, rotary drum and vertical blender types. Molten coating compositions may also be applied either by being poured onto, or spray atomized onto a moving bed of the mixture of amine reaction product with carrier.

One Typical Method Involves:

In the first part of the TSE, the active brought at a temperature between 5 and 40° C. and the amine together with the perfume mix brought at a temperature between 5 and 40° C. are incorporated into the TSE via their respective inlet and mixed together at a screw speed between 50 and 200, preferably 150 rpm, to make the resulting amine reaction product with perfume mix. Typical weight rate of material which is introduced in the TSE are of 5 to 200 kg/hour for each of the active and of the amine. The temperature within the reaction mixture is preferably within the range of 20 to 40° C. with a residence time between 10 and 45 seconds. Thereafter, the resulting product is brought along the TSE for dispersion into a carrier, preferably a carrier having a melting point between 30° C. and 135° C., the carrier having been previously brought to a temperature between 20 and 150° C. at a rate of between 50 and 200, preferably 150 kg/hour. The dispersion temperature at the end of the TSE was about 80° C. and the total residence time of the mixture within the TSE is preferably between 10 seconds to 2 minutes. The resulting dispersion is then collected for optional agglomeration and/or coating process as outlined thereafter.

Specifically, in the first part of the TSE, the Damascone brought at a temperature of 20° C. and Lupasol P (water free) with a perfume mixture brought at a temperature of 20° C. are mixed at a screw speed of 150 rpm to make the resulting amine reaction product with the perfume mixture, at a weight ratio of 20 to 40 kg/hour, preferably about 25 kg/hour, Damascone and 56 kg/hour of Lupasol P (water free) with perfume mix of which the Lupasol P (water free) is 16 kg/hour and. In the second part of the TSE, the amine reaction product is dispersed into TAE80 brought at a temperature of 70° C. at a rate of 120 kg/hour. The total production rate was thus 200 kg/hour.

Still, an alternative process for making the amine reaction product in a carrier is by a batch process using a mixing tank in which pre-or melted therein carrier, e.g. TAE80 is placed into the mixing tank before incorporation of the amine component and subsequently of the active both incorporated at room temperature.

The carried composition, or the carried composition mixed with the liquid carrier and/or the granulation aid, may comprise further compounds to control the viscosity, as described herein. Examples are asticisers like phtalates, with tactifiers like rosin acids or rosin esters, cross linking agents such as polyethylene oxide/polypropylene oxide (co)polymers, polyethylene- or propylene-glycols, pentanal, nonanal, hexanal, heptanal, octanal, or bifunctional aldehydes, such as glutaraldehyde, and/or with thickeners, such as for example used in liquid detergent compositions. These agents can give the polymer the proper carrier characteristics like the required viscosity if the viscosity is not high enough. Of course, other known viscosity enhancer may be used herein for that purpose.

Particle Size

For ease of handling and incorporation into the laundry and cleaning composition of the invention, it might be preferred to further process the carried composition. Typically, this involves making agglomerates of the above obtained viscous mix by first making a dispersion in a dispersing carrier like a water-soluble material having a melting point of from 30° C. to 135° C. like a nonionic ethoxylated alcohol surfactant and then agglomerating it with a coating material having a melting point between 35 and 135° C., like carbonate, starch, cyclodextrin, and mixtures thereof. Typical description of such process can respectively be found in co-pending application EP 99401736.6 at page 19 lines 11 to page 22 line 36 and page 28 line 31 to page 32 line 20.

Typically, the particle size of the carried composition in the dispersed carrier is from 0.1 micrometers to 150 micrometers, more preferably from 1 micrometer to 100 micrometers, and most preferably from 3 or even from 10 to 70 micrometers. When further processed, it has been found that in order for these processed carried benefit agent to impart their beneficial deposition and release on the surface, the agglomerated carried benefit agent preferably has an average particle diameter of from about 1 to about 2000 micrometers, preferably from about 150 to about 1700 micrometers, more preferably from about 250 to about 1000 micrometers. The term "average particle diameter" represents the mean particle size diameter of the actual particles of a given material. The mean is calculated on a weight percent basis. The mean is determined by conventional analytical techniques such as, for example, laser light diffraction or microscopic determination utilizing a scanning electron microscope. Preferably, greater than 50% by weight and more preferably greater than 60% by weight and most preferably greater than 70% by weight, of the particles have actual diameters which fall within the range of from about 250 to about 1000 micrometers, preferably from about 250 to about 850 micrometers.

The desired particle sizes can be achieved by, for example, mechanically grinding the resulting carried perfume composition in blenders (e.g., an Oster® blender) or in large scale mills (e.g., a Wiley® Mill) to the desired particle size range or by prilling in a conventional manner (e.g., forcing the well-circulated co-melt through a heated nozzle into cooled atmospheric temperatures).

Laundry and Cleaning and/or Fabric Care Products

The carried perfume composition is then incorporated in a laundry or cleaning and/or fabric composition. Means of incorporation into the laundry and/or cleaning and/or fabric composition are conventionally known in the art, and is typically made depending on its end form by either spraying when in sprayable liquid form, or dry-addition. Preferably, the carried composition is in processed form as mentioned above and incorporated by dry-addition.

Preferably, the carried composition which is incorporated into such laundry or cleaning and/or fabric composition provides a dry surface Odor Index of more than 5 preferably at least 10.

By Dry Surface Odor Index, it is meant that the carried composition provides a Delta of more than 5, wherein Delta is the difference between the Odor Index of the dry surface treated with the carried composition and the Odor Index of the dry surface treated with only the perfume raw material.

Measurement Method of Dry Surface Odor Index:

For the above Dry Surface Odor Index, the carried composition suitable for use in the present invention needs to fulfill the following test.

Product Preparation:

The carried composition is added to the unperfumed product base. Levels of carried composition are selected so as to obtain an odor grade on the dry fabric of at least 20. After careful mixing, by shaking the container in case of a liquid, with a spatula in case of a powder, the product is allowed to sit for 24 hrs.

Washing Process:

The resulting product is added into the washing machine in the dosage and in the dispenser appropriate for its category. The quantity corresponds to recommended dosages made for the corresponding market products: typically between 70 and 150 g for a detergent powder or liquid via current dosing device like granulette, or ariellette. The load is composed of four bath towels (170 g) using a Miele W830 washing machine at 40° C. short cycle, water input: 15° Hardness at a temperature of 10-18° C., and full spin of 1200 rpm.

The same process is applied for the corresponding free perfume ingredient in consideration and is used as the reference. Dosages, fabric loads and washing cycles for the reference and the sample are identical.

Drying Process:

Within two hours after the end of the washing cycle, the spinned but still wet fabrics are assessed for their odors using the scale mentioned below. Afterwards, half of the fabric pieces are hung on a line for 24 hr drying, away from any possible contaminations. Unless specified, this drying takes place indoor. Ambient conditions are at temperature between 18-25 C and air moisture between 50-80%. The other half is placed in a tumble drier and undergoes a full "very dry" cycle, i.e. in a Miele, Novotronic T430 set on program white-extra dry (full cycle). Tumble dry fabrics are also assessed on the next day. Fabrics are then stored in opened aluminum bags in an odor free room, and assessed again after 7 days.

Odor Evaluations:

Odor is assessed by expert panellist smelling the fabrics. A 0-100 scale is used for all fabric odor gradings. The grading scale is as follows:

100=extremely strong perfume odor
75=very strong perfume odor
50=strong odor
40=moderate perfume odor
30=slight perfume odor
20=weak perfume odor
10=very weak perfume odor
0=no odor A difference of more than 5 grades after one day and/or 7 days between the carried composition and the benefit agent, e.g. perfume is statistically significant. A difference of 10 grades or more after one day and/or 7 days represents a step-change. In other words, when a difference of grade of more than 5, preferably at least 10 is observed between the amine reaction product and the perfume raw material, after either 1 day or 7 days or both 1 day and 7 days, it can be concluded that the carried composition is suitable for use in the present invention.

The laundry or cleaning composition typically comprises one or more detergent and/or cleaning and/or surfactant ingredient, whilst the fabric care composition will typically comprises a fabric care ingredient. By "fabric care ingredient", it is meant an ingredient which provide care to the fiber integrity of the treated fabric like a color protecting agent, e.g DTI, crystal growth inhibitor, bleach quencher-scavenger, anti abrasive agent, etc. . . .

Preferably, the invention composition is a laundry and/or cleaning composition.

Laundry compositions also encompass compositions providing color care, or composition counteracting malodours, as well as compositions suitable for use in any steps of the domestic treatment, that is as a pre-treatment composition, as a wash additive as a composition suitable for use in the rinse-cycle of the laundry cycle or applied on a dryer-sheet. Obviously, multiple applications can be made such as treating the fabric with a pre-treatment composition of the invention and also thereafter with a composition of the invention suitable for use in the rinse cycle and/or suitable for use as a dryer-sheet.

The liquid finished compositions of the invention may also be in a spray, foam, or aerosol form which for example can be suitable for use while ironing, or applied on the surfaces of the tumble dryer.

Laundry compositions encompass laundry detergent compositions, including liquid, solid form like powdered, tablets as well as softening compositions including rinse added softening composition as well as dryer added softening compositions.

A conventional disclosure of softening ingredients to be used in the softening composition of the invention can be found in EP 98870227.0, incorporated herein by reference, which typically include components selected from a surfactant like a quaternary ammonium softening component, a stabilising agent like a nonionic ethoxylated surfactant, a chelating agent, a crystal growth inhibitor, a soil release agent, a polyalkyleneimine component, brighteners, preservatives, antibacterials, cyclodextrins, and mixtures thereof.

A conventional disclosure of a laundry or cleaning composition can be found in EP-A-0,659,876 and European patent application No. 98870226.2 which are both incorporated herein by reference.

Typical laundry or cleaning composition comprises a detergent and/or cleaning ingredient. By detergent or cleaning ingredient, it is meant ingredient which are respectively conventional to the detergent composition or cleaning composition. Typical of conventionals in detergent compositions includes one or more of surfactants, or organic and inorganic builders. The preferred laundry or cleaning composition, embodiment of the invention, will also preferably contain a bleaching system and/or other components conventional in detergent compositions. Typical of bleaching systems include a peroxyacid, a hypohalite, or a bleach precursor with a source of alkaline hydrogen peroxide necessary to form a peroxyacid bleaching species in the wash solution. Other optionals include soil suspending and anti-redeposition agents, suds suppressors, enzymes, fluorescent whitening agents, photoactivated bleaches, perfumes, colours, and mixtures thereof.

Preferably, the finished composition is a detergent composition, more preferably in solid form.

In addition, when the composition is a laundry composition, it is preferred that the detergent composition comprises a clay.

Clay

The compositions of the invention may preferably contain a clay, preferably present at a level of from 0.05% to 40%, more preferably from 0.5% to 30%, most preferably from 2% to 20% by weight of the composition. For clarity, it is noted that the term clay mineral compound, as used herein, excludes sodium aluminosilicate zeolite builder compounds, which however, may be included in the compositions of the invention as optional components.

One preferred clay may be a bentonite clay. Highly preferred are smectite clays, as for example disclosed in the U.S. Pat. Nos. 3,862,058 3,948,790, 3,954,632 and 4,062,647 and European Patents Nos. EP-A-299,575 and EP-A-313,146 all in the name of the Procter and Gamble Company.

The term smectite clays herein includes both the clays in which aluminium oxide is present in a silicate lattice and the clays in which magnesium oxide is present in a silicate lattice. Smectite clays tend to adopt an expandable three layer structure.

Specific examples of suitable smectite clays include those selected from the classes of the montmorillonites, hectorites, volchonskoites, nontronites, saponites and sauconites, particularly those having an alkali or alkaline earth metal ion within the crystal lattice structure. Sodium or calcium montmorillonite are particularly preferred.

Suitable smectite clays, particularly montmorillonites, are sold by various suppliers including English China Clays, Laviosa, Georgia Kaolin and Colin Stewart Minerals.

Clays for use herein preferably have a particle dimension of from 10 nm to 800 nm more preferably from 20 nm to 500 mm, most preferably from 50 nm to 200 mm.

Particles of the clay mineral compound may be included as components of agglomerate particles containing other detergent compounds. Where present as such components, the term "largest particle dimension" of the clay mineral compound refers to the largest dimension of the clay mineral component as such, and not to the agglomerated particle as a whole.

Substitution of small cations, such as protons, sodium ions, potassium ions, magnesium ions and calcium ions, and of certain organic molecules including those having positively charged functional groups can typically take place within the crystal lattice structure of the smectite clays. A clay may be chosen for its ability to preferentially absorb one cation type, such ability being assessed by measurements of relative ion exchange capacity. The smectite clays suitable herein typically have a cation exchange capacity of at least 50 meq/100 g. U.S. Pat. No. 3,954,632 describes a method for measurement of cation exchange capacity. The crystal lattice structure of the clay mineral compounds may have, in a preferred execution, a cationic fabric softening agent substituted therein. Such substituted clays have been termed 'hydrophobically activated' clays. The cationic fabric softening agents are typically present at a weight ratio, cationic fabric softening agent to clay, of from 1:200 to 1:10, preferably from 1:100 to 1:20. Suitable cationic fabric softening agents include the water insoluble tertiary amines or dilong chain amide materials as disclosed in GB-A-1 514 276 and EP-B-0 011 340.

A preferred commercially available "hydrophobically activated" clay is a bentonite clay containing approximately 40% by weight of a dimethyl ditallow quaternary ammonium salt sold under the tradename Claytone EM by English China Clays International.

In a highly preferred embodiment of the invention, the clay is present in an intimate mixture or in a particle with a humectant and a hydrophobic compound, preferably a wax or oil, such as paraffin oil. Preferred humectants are organic compounds, including propylene glycol, ethylene glycol, dimers or trimers of glycol, most preferably glycerol. The particle is preferably an agglomerate. Alternatively, the particle may be such that the wax or oil and optionally the humectant form an encapsulate on the clay or alternatively, the clay be a encapsulate for the wax or oil and the humectant. It may be preferred that the particle comprises an organic salt or silica or silicate.

However, in another embodiment of the invention, the clay is preferably mixed with one or more surfactants and optionally builders and optionally water, in which case the mixture is preferably subsequently dried. Preferably, such a mixture is further processed in a spray-drying method to obtain a spray dried particle comprising the clay.

It may be preferred that the flocculating agent is also comprised in the particle or granule comprising the clay.

It may also be preferred that the intimate mixture comprises a chelating agent.

Flocculating Agent

The compositions of the invention may contain a clay flocculating agent, preferably present at a level of from 0.005% to 10%, more preferably from 0.05% to 5%, most preferably from 0.1% to 2% by weight of the composition.

The clay flocculating agent functions such as to bring together the particles of clay compound in the wash solution and hence to aid their deposition onto the surface of the fabrics in the wash. This functional requirement is hence different from that of clay dispersant compounds which are commonly added to laundry detergent compositions to aid the removal of clay soils from fabrics and enable their dispersion within the wash solution.

Preferred as clay flocculating agents herein are organic polymeric materials having an average weight of from 100,000 to 10,000,000, preferably from 150,000 to 5,000,000, more preferably from 200,000 to 2,000,000.

Suitable organic polymeric materials comprise homopolymers or copolymers containing monomeric units selected from alkylene oxide, particularly ethylene oxide, acrylamide, acrylic acid, vinyl alcohol, vinyl pyrrolidone, and ethylene imine. Homopolymers of, on particular, ethylene oxide, but also acrylamide and acrylic acid are preferred.

European Patents Nos. EP-A-299,575 and EP-A-313,146 in the name of the Procter and Gamble Company describe preferred organic polymeric clay flocculating agents for use herein.

The weight ratio of clay to the flocculating polymer is preferably from 1000:1 to 1:1, more preferably from 500:1 to 1:1, most preferably from 300:1 to 1:1, or even more preferably from 80:1 to 10:1, or in certain applications even from 60:1 to 20:1.

Inorganic clay flocculating agents are also suitable herein, typical examples of which include lime and alum.

The flocculating agent is preferably present in a detergent base granule such as a detergent agglomerate, extrudate or spray-dried particle, comprising generally one or more surfactants and builders.

Effervescent

Effervescent means may also be optionally used in the compositions of the invention.

Effervescency as defined herein means the evolution of bubbles of gas from a liquid, as the result of a chemical reaction between a soluble acid source and an alkali metal carbonate, to produce carbon dioxide gas, i.e. $C_6H_8O_7+3NaHCO_3 \rightarrow Na_3C_6H_5O_7+3CO_2\uparrow+3H_2O$ Further examples of acid and carbonate sources and other effervescent systems may be found in (Pharmaceutical Dosage Forms: Tablets Volume 1 Page 287 to 291).

Carbonate Salts

Suitable alkali and/or earth alkali inorganic carbonate salts herein include carbonate and hydrogen carbonate of potassium, lithium, sodium, and the like amongst which sodium and potassium carbonate are preferred. Suitable bicarbonates to be used herein include any alkali metal salt of bicarbonate like lithium, sodium, potassium and the like, amongst which sodium and potassium bicarbonate are preferred. However, the choice of carbonate or bicarbonate or mixtures thereof may be made depending on the pH desired in the aqueous medium wherein the granules are dissolved. For example where a relative high pH is desired in the aqueous medium (e.g., above pH 9.5) it may be preferred to use carbonate alone or to use a combination of carbonate and bicarbonate wherein the level of carbonate is higher than the level of bicarbonate. The inorganic alkali and/or earth alkali carbonate salt of the compositions of the invention comprises preferably a potassium or more preferably a sodium salt of carbonate and/or bicarbonate. Preferably, the carbonate salt comprises sodium carbonate, optionally also a sodium bicarbonate.

The inorganic carbonate salts herein are preferably present at a level of at least 20% by weight of the composition. Preferably they are present at a level of at least 23% or even 25% or even 30% by weight, preferably up to about 60% by weight or more preferably up to 55% or even 50% by weight.

They may be added completely or partially as separate powdered or granular component, as co-granules with other detergent ingredients, for example other salts or surfactants. In solid detergent compositions of the invention, they may also completely or partially be present in detergent granules such as agglomerates or spray dried granules.

In one embodiment of the invention, an effervescence source is present, preferably comprising an organic acid, such as carboxylic acids or aminoacids, and a carbonate. Then it may be preferred that part or all of the carbonate salt herein is premixed with the organic acid, and thus present in an separate granular component.

Preferred effervescent source are selected from compressed particles of citric acid and carbonate optionally with a binder; and particle of carbonate, bicarbonate and malic or maleic acid in weight ratios of 4:2:4. The dry add form of citric acid and carbonate are preferably used.

The carbonate may have any particle size. In one embodiment, in particular when the carbonate salt is present in a granule and not as separately added compound, the carbonate salt has preferably a volume median particle size from 5 to 375 micrometers, whereby preferably at least 60%, preferably at least 70% or even at least 80% or even at least 90% by volume, has a particle size of from 1 to 425 micrometers. More preferably, the carbon dioxide source has a volume median particle size of 10 to 250, whereby preferably at least 60%, or even at least 70% or even at least 80% or even at least 90% by volume, has a particle size of from 1 to 375 micrometers; or even preferably a volume median particle size from 10 to 200 micrometers, whereby preferably at least 60%, preferably at least 70% or even at least 80% or even at least 90% by volume, has a particle size of from 1 to 250 micrometers.

In particular when the carbonate salt is added as separate component, so to say 'dry-added' or admixed to the other detergent ingredients, the carbonate may have any particle size, including the above specified particle sizes, but preferably at least an volume average particle size of 200 micrometers or even 250 micrometers or even 300 micrometers.

It may be preferred that the carbon dioxide source of the required particle size is obtained by grinding a larger particle size material, optionally followed by selecting the material with the required particle size by any suitable method.

Whilst percarbonate salts may be present in the compositions of the invention as a bleaching agent, they are not included in the carbonate salts as defined herein Form of the Composition The composition of the invention may take a variety of physical form including liquid, gel, foam in either aqueous or non-aqueous form, or solid form, including bar, beads, granular and tablet forms.

Still in another aspect of the invention, there is provided a packaged composition comprising the processed product of the invention or composition of the invention. Preferably, the packaged composition is a closed packaging system having a moisture vapour transmission rate of less than 20 $g/m^2/24$ hours. Typical disclosure of such a package can be found in WO 98/40464.

Still another preferred package is a spray dispenser.

Spray Dispenser

The present invention also relates to such compositions incorporated into a spray dispenser to create an article of manufacture that can facilitate treatment of fabric articles and/or surfaces with said compositions containing the amine reaction product and other ingredients (examples are cyclodextrins, polysaccharides, polymers, surfactant, perfume, softener) at a level that is effective, yet is not discernible when dried on the surfaces. The spray dispenser comprises manually activated and non-manual powered (operated) spray means and a container containing the treating composition. Typical disclosure of such spray dispenser can be found in WO 96/04940 page 19 line 21 to page 22 line 27. The articles of manufacture preferably are in association with instructions for use to ensure that the consumer applies sufficient ingredient of the composition to provide the desired benefit. Typical compositions to be dispensed from a sprayer contain a level of amine reaction product of from about 0.01% to about 5%, preferably from about 0.05% to about 2%, more preferably from about 0.1% to about 1%, by weight of the usage composition.

Method

Also provided herein is a method for providing an enhanced deposition as well as a delayed release of the benefit agent, preferably a perfume composition, which comprises the step of contacting the surface to be treated with a composition of the invention, and preferably thereafter contacting the treated surface with a material, preferably an aqueous medium like moisture or any other means susceptible of releasing the perfume from the composition.

By "surface", it is meant any surface onto which the compound can deposit. Typical examples of such material are fabrics, hard surfaces such as dishware, floors, bathrooms, toilet, kitchen and other surfaces in need of a delayed release of a perfume such as that with litter like animal litter. Preferably, the surface is selected from a fabric, a tile, a ceramic; more preferably is a fabric.

By "enhanced deposition", it is meant a better deposition of the benefit agent (e.g. perfume) on the treated surface than by the use of the benefit agent (e.g. perfume) itself.

By "delayed release" is meant release of the benefit agent (e.g perfume) over a longer period of time than by the use of the benefit agent (e.g., perfume) itself.

Where the carrier is a polymer or component which has been chemically reacted with a benefit agent like perfume, the release of the benefit agent which is entrapped or embedded within the reacted carrier, i.e. not chemically reacted, is released from the carried benefit agent composition by hydrolysis of the reacted carrier. Indeed, the hydrolysis of the "protective shell" made by the reacted carrier into the respective aldehyde and/or ketone on the one hand and the polymer on the other will gradually open the shell, thereby enabling release of the entrapped benefit agent.

Still in another aspect of the invention, there is provided the use of the product of the invention for the manufacture of a laundry and cleaning composition for delivering residual fragrance onto the fabrics on which it is applied.

For the purposes of the present invention the term "contacting" is defined as "intimate contact of a surface with an aqueous solution of the hereinabove described composition." Contacting typically occurs by soaking, washing, rinsing the composition onto fabric, but can also include contact of a substrate inter alia a material onto which the composition has been absorbed, with the fabric.

EXAMPLES

I—Synthesis Example of a Carrier and a Perfume Mix Benefit Agent

In a reaction vessel of 21, placed on a rotary evaporator, 10 g of δ-Damascone and 150 g of Lupasol P (about 50% of water) and 175 g of a perfume mixture are mixed together for 4 hours at 42° C. The temperature of the reaction mixture, during the mixing, is controlled via a thermostat and not allowed to go higher than 42° C. 335 g of product is obtained and only traces of unreacted δ-Damascone remain. The viscosity of the synthesised product is 55000 cps.

II—Synthesis Example of a Carrier and a Perfume Mix Benefit Agent

In a reaction vessel of 250 ml, 20 g of Lilial and 16 g of water-free Lupasol P (water-free Lupasol P is taken from the commercial Lupasol sample from which the water has been removed by vacuum distillation) and 83 g of a perfume mixture are mixed together for 4 hours at 42° C. The temperature of the reaction mixture, during the mixing, is controlled via a thermostat and not allowed to go higher than 42° C. 118 g of product is obtained and only traces of unreacted Lilial remain. The viscosity of the synthesised product is 1600 cps.

III—Synthesis Example of a Carrier and a Perfume Mix Benefit Agent

In a reaction vessel of 250 ml, 12 g of Carvone and 10 g of waterfree Lupasol P and 49 g of a perfume mixture are mixed together for 4 hours at 42° C. The temperature of the reaction mixture, during the mixing, is controlled via a thermostat and not allowed to go higher than 42° C. 71 g of product is obtained and most of the Carvone has reacted. The viscosity of the synthesised product is 2300 cps.

IV—Synthesis Example of a Carrier and a Perfume Mix Benefit Agent

In a reaction vessel of 250 ml, 12 g of Triplal and 10 g of waterfree Lupasol P and 22 g of a perfume mixture are mixed together for 4 hours at 42° C. The temperature of the reaction mixture, during the mixing, is controlled via a thermostat and not allowed to go higher than 42° C. 42 g of product is obtained and only traces of unreacted Triplal remain. The viscosity of the synthesised product is 9764 cps.

V—Synthesis Example of a Benefit Agent with a Carrier

Lupasol WF was reacted with palmitoylchloride. 32 g of LupasolWF was dissolved in 250 ml of dry dichloromethane. The solution was cooled to 0 C and 76 ml of palmitoyl chloride dissolved in 50 ml dry dichloromethane with a dropping funnel. The solution was stirred 1 hour under N2 atmosphere. The reaction products were washed with a saturated water solution of potassiumcarbonate. After washing, the reaction product is dried by vacuum distillation. 88 g of reaction product is obtained.

8 g of the above product is mixed with 24 g of perfume mix at 40 C till a yellow viscous and homogeneous product is obtained.

Any type of perfume mixture may be used. One preferred composition of the perfume mix is as follows:

| | |
|---|---|
| Citronellol | 7 |
| Geraniol | 7 |
| Linalool | 7 |
| Para Tertiary Butyl Cyclohexyl Acetate | 10 |
| Phenyl Ethyl Alcohol | 19 |
| Habanolide | 4.5 |
| Para Methoxy Acetophenone | 1.5 |
| Benzyl Acetate | 4 |
| Eugenol | 2 |
| Phenyl Ethyl Acetate | 5 |
| Verdyl Acetate | 6 |
| Verdyl Propionate | 4 |
| Hexyl Cinnamic Aldehyde | 3 |
| Ionone Gamma Methyl | 2 |
| Methyl Cedrylone | 10 |
| P.T. Bucinal | 7 |
| Para Cresyl Methyl Ether | 1 |

The synthesised "carried composition" may be used as is or may be further processed to enable easy incorporation into finished product.

VI—Synthesis Example of a Carrier and a Perfume Mix Benefit Agent

In a reaction vessel of 250 ml, 8 gms of perfume mix FC1 and 2.5 g of waterfree Lupasol WF is mixed together for 30 minutes hours at room temperature C. The temperature of the reaction mixture, during the mixing, is controlled via a thermostat and not allowed to go higher than 80 C. After mixing the mixture is kept overnight in a waterbath at 60 C. The product thus obtained is a mixture of Lupasol completely reacted with molar proportions of each of the aldehydes of FC1, and unreacted aldehydes of FC1. All of the Lupasol WF is assumed to be reacted. The viscosity of the synthesised product is 190,000 cps.

| | |
|---|---|
| FC1 | — |
| Methyl Nonyl Acetaldehyde | 15 |
| Undecylenic Aldehyde | 30 |
| Triplal | 35 |
| Lauric Aldehyde | 19.5 |
| Iris Aldehyde | 0.5 |

Processing Method

Processing of the carried composition is done as follows: 80 g of one of the carried composition as above synthesised is mixed in an Ultra Turrax containing 120 g of dispersing carrier, e.g. TAE80 or PEG 1000 to 10,000, for 5 minutes, the temperature of mixing being of about 70° C. (melting temperature of the carrier), and the speed of the mixer being sufficient so as to maintain such temperature substantially constant. Temperature and time will depend on the nature of the dispersing carrier but are conventional steps to the skilled man. The resulting mixture is maintained at a temperature substantially equal to the melting point of the carrier material. Once the mixture is at a suitable temperature, it is poured onto the coating material i.e. carbonate and agglomerated in an electrical mixer like a Braun Mixer. Care is also taken that the temperature during the mixing does not substantially exceed the melting point of the carrier material. For example, 150 g of a mixture containing 90 g TAE80 and 60 g of the carried composition is poured at 60° C. into a Braun Mixer containing 300 g of carbonate. The mixing of the ingredients is carried out for about 5 minutes. Care is also taken that the temperature during the mixing does not exceed 65° C. Again, temperature and time will depend on the nature of the coating agent but are conventional steps to the skilled man.

Abbreviations Used in the Following Laundry and Cleaning Composition Examples

In the laundry and cleaning compositions, the abbreviated component identifications have the following meanings:

| | |
|---|---|
| DEQA | Di-(tallowyl-oxy-ethyl) dimethyl ammonium chloride |
| DTDMAC | Ditallow dimethylammonium chloride |
| DEQA (2) | Di-(soft-tallowyloxyethyl) hydroxyethyl methyl ammonium methylsulfate. |
| DTDMAMS | Ditallow dimethyl ammonium methylsulfate. |
| SDASA | 1:2 ratio of stearyldimethyl amine:triple-pressed stearic acid. |
| Fatty acid | Stearic acid of IV = 0 |
| Electrolyte | Calcium chloride |
| PEG | Polyethylene Glycol 4000 |
| Neodol 45-13 | C14-C15 linear primary alcohol ethoxylate, sold by Shell Chemical CO. |
| Silicone antifoam | Polydimethylsiloxane foam controller with siloxane-oxyalkylene copolymer as dispersing agent with a ratio of said foam controller to said dispersing agent of 10:1 to 100:1. |
| PEI | Polyethyleneimine with an average molecular weight of 1800 and an average ethoxylation degree of 7 ethyleneoxy residues per nitrogen |
| HEDP | 1,1-hydroxyethane diphosphonic acid |
| LAS | Sodium linear $C_{11-13}$ alkyl benzene sulfonate |
| TAS | Sodium tallow alkyl sulfate |
| CxyAS | Sodium $C_{1x}$-$C_{1y}$ alkyl sulfate |
| C46SAS | Sodium $C_{14}$-$C_{16}$ secondary (2,3) alkyl sulfate |
| CxyEzS | Sodium $C_{1x}$-$C_{1y}$ alkyl sulfate condensed with z moles of ethylene oxide |
| CxyEz | $C_{1x}$-$C_{1y}$ predominantly linear primary alcohol condensed with an average of z moles of ethylene oxide |
| QAS | $R_2 \bullet N^+(CH_3)_2(C_2H_4OH)$ with $R_2 = C_{12}$-$C_{14}$ |
| QAS 1 | $R_2 \bullet N^+(CH_3)_2(C_2H_4OH)$ with $R_2 = C_8$-$C_{11}$ |
| APA | $C_8$-$C_{10}$ amido propyl dimethyl amine |
| Soap | Sodium linear alkyl carboxylate derived from an 80/20 mixture of tallow and coconut fatty acids |
| STS | Sodium toluene sulphonate |
| CFAA | $C_{12}$-$C_{14}$ (coco) alkyl N-methyl glucamide |
| TFAA | $C_{16}$-$C_{18}$ alkyl N-methyl glucamide |
| TPKFA | $C_{12}$-$C_{14}$ topped whole cut fatty acids |
| STPP | Anhydrous sodium tripolyphosphate |
| TSPP | Tetrasodium pyrophosphate |
| Zeolite A | Hydrated sodium aluminosilicate of formula $Na_{12}(AlO_2SiO_2)_{12} \bullet 27H_2O$ having a primary particle size in the range from 0.1 to 10 micrometers (weight expressed on an anhydrous basis) |
| NaSKS-6 | Crystalline layered silicate of formula $\delta$-$Na_2Si_2O_5$ |
| Citric acid | Anhydrous citric acid |
| Borate | Sodium borate |
| Carbonate | Anydrous sodium carbonate with a particle size between 200 μm and 900 μm |
| Bicarbonate | Anhydrous sodium bicarbonate with a particle size distribution between 400 μm and 1200 μm |
| Silicate | Amorphous sodium silicate ($SiO_2$:$Na_2O$ = 2.0:1) |
| Sulfate | Anhydrous sodium sulfate |
| Mg sulfate | Anhydrous magnesium sulfate |
| Citrate | Tri-sodium citrate dihydrate of activity 86.4% with a particle size distribution between 425 μm and 850 μm |
| MA/AA | Copolymer of 1:4 maleic/acrylic acid, average molecular weight about 70,000 |
| MA/AA (1) | Copolymer of 4:6 maleic/acrylic acid, average molecular weight about 10,000 |
| AA | Sodium polyacrylate polymer of average molecular weight 4,500 |
| CMC | Sodium carboxymethyl cellulose |

-continued

| | |
|---|---|
| Cellulose ether | Methyl cellulose ether with a degree of polymerization of 650 available from Shin Etsu Chemicals |
| Protease | Proteolytic enzyme, having 3.3% by weight of active enzyme, sold by NOVO Industries A/S under the tradename Savinase |
| Protease I | Proteolytic enzyme, having 4% by weight of active enzyme, as described in WO 95/10591, sold by Genencor Int. Inc. |
| Alcalase | Proteolytic enzyme, having 5.3% by weight of active enzyme, sold by NOVO Industries A/S |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Lipase | Lipolytic enzyme, having 2.0% by weight of active enzyme, sold by NOVO Industries A/S under the tradename Lipolase |
| Lipase (1) | Lipolytic enzyme, having 2.0% by weight of active enzyme, sold by NOVO Industries A/S under the tradename Lipolase Ultra |
| Endolase | Endoglucanase enzyme, having 1.5% by weight of active enzyme, sold by NOVO Industries A/S |
| PB4 | Sodium perborate tetrahydrate of nominal formula $NaBO_2 \bullet 3H_2O \bullet H_2O_2$ |
| PB1 | Anhydrous sodium perborate bleach of nominal formula $NaBO_2 \bullet H_2O_2$ |
| Percarbonate | Sodium percarbonate of nominal formula $2Na_2CO_3 \bullet 3H_2O_2$ |
| NOBS | Nonanoyloxybenzene sulfonate in the form of the sodium salt |
| NAC-OBS | (6-nonamidocaproyl) oxybenzene sulfonate |
| TAED | Tetraacetylethylenediamine |
| DTPA | Diethylene triamine pentaacetic acid |
| DTPMP | Diethylene triamine penta (methylene phosphonate), marketed by Monsanto under the Tradename Dequest 2060 |
| EDDS | Ethylenediamine-N,N'-disuccinic acid, (S,S) isomer in the form of its sodium salt. |
| Photoactivated bleach (1) | Sulfonated zinc phthlocyanine encapsulated in dextrin soluble polymer |
| Photoactivated bleach (2) | Sulfonated alumino phthlocyanine encapsulated in dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate |
| HEDP | 1,1-hydroxyethane diphosphonic acid |
| PEGx | Polyethylene glycol, with a molecular weight of x (typically 4,000) |
| PEO | Polyethylene oxide, with an average molecular weight of 200000 to 400000 |
| TEPAE | Tetraethylenepentaamine ethoxylate |
| PVI | Polyvinyl imidosole, with an average molecular weight of 20,000 |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| QEA | $biS((C_2H_5O)(C_2H_4O)_n)(CH_3)—N^+C_6H_{12}—N^+—(CH_3)$ $biS((C_2H_5O)—(C_2H_4O))_n$, wherein n = from 20 to 30 |
| SRP 1 | Anionically end capped poly esters |
| SRP 2 | Diethoxylated poly (1, 2 propylene terephtalate) short block polymer |
| PEI | Polyethyleneimine with an average molecular weight of 1800 and an average ethoxylation degree of 7 ethyleneoxy residues per nitrogen |
| Silicone antifoam | Polydimethylsiloxane foam controller with siloxane-oxyalkylene copolymer as dispersing agent with a ratio of said foam controller to said dispersing agent of 10:1 to 100:1 |
| Opacifier | Water based monostyrene latex mixture, sold by BASF Aktiengesellschaft under the tradename Lytron 621 |
| Wax | Paraffin wax |
| PA30 | Polyacrylic acid of average molecular weight of between about 4,500-8,000. |
| 480N | Random copolymer of 7:3 acrylate/methacrylate, average molecular weight about 3,500. |
| Polygel/carbopol | High molecular weight crosslinked polyacrylates. |
| Metasilicate | Sodium metasilicate ($SiO_2$:$Na_2O$ ratio = 1.0). |
| Nonionic | $C_{13}$-$C_{15}$ mixed ethoxylated/propoxylated fatty alcohol with an average degree of ethoxylation of 3.8 and an average degree of propoxylation of 4.5. |
| Neodol 45-13 | C14-C15 linear primary alcohol ethoxylate, sold by Shell Chemical CO. |
| MnTACN | Manganese 1,4,7-trimethyl-1,4,7-triazacyclononane. |
| PAAC | Pentaamine acetate cobalt(III) salt. |

-continued

| | |
|---|---|
| Paraffin | Paraffin oil sold under the tradename Winog 70 by Wintershall. |
| NaBz | Sodium benzoate. |
| BzP | Benzoyl Peroxide. |
| SCS | Sodium cumene sulphonate. |
| BTA | Benzotriazole. |
| PH | Measured as a 1% solution in distilled water at 20° C. |
| CaP1 | Processed amine reaction product of d-Damascone with Lupasol P and perfume mix as made from Synthesis example I, mixed with a carrier and agglomerated with TAE80 coating agent according to processing method above described. |
| CaP2 | Processed amine reaction product of Lupasol P with Lilial and perfume mix as made from Synthesis example II, and agglomerated with PEG4000 and carbonate coating agent according to processing method above described. |
| CaP 3 | Processed amine reaction product of Lupasol P with Carvone and perfume mix as made from Synthesis example III, mixed with a carrier and agglomerated with TAE80 coating agent according to processing method above described. |
| CaP 4 | Processed amine reaction product of Lupasol P with Triplal and perfume mix as made from Synthesis example IV, mixed with a carrier and agglomerated with PEG4000 coating agent according to processing method above described. |
| CaP 5 | Processed amine reaction product of Lupasol WF with palmitoylchloride and perfume mix. as made from Synthesis example V, mixed with, a carrier and agglomerated with TAE80 coating agent according to processing method above described. |
| CAP6 | Processed amine reaction product of Lupasol P with Lilial and perfume mix as made from Synthesis example II, |
| CAP7 | Processed amine reaction product of Lupasol P with Carvone and perfume mix as made from Synthesis example III, |
| CAP8 | Processed amine reaction product of Lupasol P with Triplal and perfume mix as made from Synthesis example IV, |
| CAP9 | Processed amine reaction product of Lupasol WF and perfume mix as made in Synthesis example VI |
| Clay I | Bentonite clay |
| Clay II | Smectite clay |
| Flocculating agent I | polyethylene oxide of average molecular weight of between 200,000 and 400,000 |
| Flocculating agent II | polyethylene oxide of average molecular weight of between 400,000 and 1,000,000 |
| Flocculating agent III | polymer of acrylamide and/or acrylic acid of average molecular weight of 200,000 and 400,000 |
| DOBS | Decanoyl oxybenzene sulfonate in the form of the sodium salt |
| SRP 3 | Polysaccharide soil release polymer |
| SRP 4 | Nonionically end capped poly esters |
| Polymer | Polyvinylpyrrolidone K90 available from BASF under the tradename Luviskol K90 |
| Dye fixative | Dye fixative commercially available from Clariant under the tradename Cartafix CB |
| Polyamine | 1,4-Bis-(3-aminopropyl)piperazine |
| Bayhibit AM | 2-Phosphonobutane-1,2,4-tricarboxylic acid commercially available from Bayer |
| Fabric softener active | Di-(canoloyl-oxy-ethyl)hydroxyethyl methyl ammonium methylsulfate |
| HPBDC | Hydroxypropyl beta-cyclodextrin |
| RAMEB | Randomly methylated beta-cyclodextrin |
| Bardac 2050 | Dioctyl dimethyl ammonium chloride, 50% solution |
| Bardac 22250 | Didecyl dimethyl ammonium chloride, 50% solution |
| Genamin C100 | Coco fatty amine ethoxylated with 10 moles ethylene oxide and commercially available from Clariant |
| Genapol V4463 | Coco alcohol ethoxylated with 10 moles ethylene oxide and commercially available from Clariant |
| Silwet 7604 | Polyalkyleneoxide polysiloxanes of MW 4000 of formula $R—(CH_3)_2SiO—[(CH_3)_2SiO]_a—[(CH_3)(R)SiO]_b—Si(CH_3)_2—R$, wherein average a + b is 21, and commercially available from Osi Specialties, Inc., Danbury, Connecticut |

-continued

| | |
|---|---|
| Silwet 7600 | Polyalkyleneoxide polysiloxanes of MW 4000, of formula $R—(CH_3)_2SiO—[(CH_3)_2SiO]_a—[(CH_3)(R)SiO]_b—Si(CH_3)_2—R$, wherein average a + b is 11, and commercially available from Osi Specialties, Inc., Danbury, Connecticut |

In the following formulation examples all levels are quoted as % by weight of the composition unless otherwise stated, and incorporation of the carried perfume composition so called herein after "CAP" in the fully formulated composition is carried out as is.

Example 1

The following high density granular laundry detergent compositions are in accord with the invention:

| | A | B | C | D | E |
|---|---|---|---|---|---|
| LAS | 6.0 | 6.0 | 8.0 | 8.0 | 8.0 |
| TAS | 1.0 | 0.1 | — | 0.5 | — |
| C46(S)AS | — | — | 2.0 | 2.5 | — |
| C25AS | 4.5 | 5.5 | — | — | — |
| C68AS | — | — | 2.0 | 5.0 | 7.0 |
| C25E5 | 4.6 | 4.6 | — | — | 3.4 |
| C25E7 | — | — | 3.4 | 3.4 | 1.0 |
| C25E3S | 5.0 | 4.5 | — | — | — |
| QAS | — | — | — | 0.8 | — |
| QAS (I) | 0.5 | 1.0 | — | — | — |
| Zeolite A | 20.0 | 18.1 | 18.1 | 18.0 | 14.1 |
| Citric acid | — | 2.5 | — | — | — |
| Carbonate | 10.0 | 13.0 | 13.0 | 13.0 | 25.0 |
| SKS-6 | — | 10.0 | — | — | — |
| Silicate | 0.5 | 0.3 | 1.4 | 1.4 | 3.0 |
| Citrate | — | — | — | 1.0 | — |
| Sulfate | — | — | 26.1 | 26.1 | 26.1 |
| Mg sulfate | — | 0.2 | 0.3 | — | — |
| MA/AA | 1.0 | 1.0 | 0.3 | 0.3 | 0.3 |
| CMC | 0.4 | 0.4 | 0.2 | 0.2 | 0.2 |
| PB4 | — | — | 9.0 | 9.0 | 5.0 |
| Percarbonate | 18.0 | 18.0 | — | — | — |
| TAED | 3.9 | 4.2 | 1.5 | 0.4 | 1.5 |
| NAC-OBS | — | — | — | 2.0 | 1.0 |
| DTPMP | — | — | 0.25 | 0.25 | 0.25 |
| SRP 2 | — | 0.2 | — | — | — |
| EDDS | 0.5 | 0.5 | — | 0.25 | 0.4 |
| CFAA | — | — | — | 1.0 | — |
| HEDP | 0.4 | 0.4 | 0.3 | 0.3 | 0.3 |
| QEA | — | 0.5 | — | — | — |
| Protease I | — | — | — | — | 0.26 |
| Protease | 1.5 | 1.0 | 0.26 | 0.26 | — |
| Cellulase | 0.3 | 0.3 | 0.3 | — | — |
| Amylase | 0.5 | 0.5 | 0.1 | 0.1 | 0.1 |
| Lipase (1) | 0.5 | 0.5 | 0.3 | — | — |
| Photoactivated bleach (ppm) | 20 ppm | 20 ppm | 15 ppm | 15 ppm | 15 ppm |
| Brightener 1 | 0.09 | 0.09 | 0.09 | 0.09 | 0.09 |
| Perfume spray on | 0.4 | 0.08 | 0.05 | 0.3 | 0.3 |
| CAP 1 | 2.0 | 1.0 | 0.05 | 0.1 | 0.5 |
| CAP 3 | — | 0.5 | — | — | — |
| Silicone antifoam | 0.3 | 0.3 | 0.5 | 0.5 | 0.5 |
| Misc/minors to 100% | | | | | |
| Density in g/litre | 850 | 850 | 850 | 850 | 850 |

| | F | G | H | I |
|---|---|---|---|---|
| LAS | 2.0 | 6.0 | 6.0 | 5.0 |
| TAS | 0.5 | 1.0 | 0.1 | 1.5 |
| C25AS | 7.0 | 4.5 | 5.5 | 2.5 |
| C68AS | — | — | — | 0.2 |
| C25E5 | 10.0 | 4.6 | 4.6 | 2.6 |
| C25E3S | 2.0 | 5.0 | 4.5 | 0.5 |

-continued

| | | | | |
|---|---|---|---|---|
| QAS (I) | 0.8 | 0.5 | 1.0 | 1.5 |
| Zeolite A | 18.1 | 20.0 | 18.1 | 16.2 |
| Citric acid | 2.5 | — | 2.5 | 1.5 |
| Carbonate | 10.0 | 10.0 | 13.0 | 20.6 |
| SKS-6 | 10.0 | — | 10.0 | 4.3 |
| Silicate | 0.3 | 0.5 | 0.3 | — |
| Citrate | 3.0 | — | — | 1.4 |
| Sulfate | 6.0 | — | — | — |
| Mg sulfate | 0.2 | — | 0.2 | 0.03 |
| MA/AA | 4.0 | 1.0 | 1.0 | 0.6 |
| CMC | 0.2 | 0.4 | 0.4 | 0.3 |
| Percarbonate | — | 18.0 | 18.0 | 9.0 |
| TAED | — | 3.9 | 4.2 | 3.2 |
| DTPMP | 0.25 | — | — | — |
| SRP 2 | 0.2 | — | 0.2 | — |
| EDDS | — | 0.5 | 0.5 | 0.1 |
| CFAA | 2.0 | — | — | — |
| TFAA | — | — | — | 1.1 |
| HEDP | 0.3 | 0.4 | 0.4 | 0.3 |
| QEA | 0.2 | — | 0.5 | — |
| Protease I | 1.0 | — | — | 0.3 |
| Protease | — | 1.5 | 1.0 | — |
| Cellulase | 0.3 | 0.3 | 0.3 | 0.3 |
| Amylase | 0.4 | 0.5 | 0.5 | 0.1 |
| Lipase (1) | 0.5 | 0.5 | 0.5 | 0.1 |
| Photoactivated bleach (ppm) | — | 20 ppm | 20 ppm | 20 ppm |
| PVNO/PVPVI | 0.1 | — | — | — |
| Brightener 1 | — | 0.09 | 0.09 | 0.01 |
| Brightener 2 | — | — | — | 0.09 |
| Perfume spray on | 0.4 | 0.4 | 0.04 | — |
| CAP 2 | 2.0 | 1.0 | 0.1 | 0.8 |
| Silicone antifoam | — | 0.3 | 0.3 | 0.3 |
| Clay II | — | — | — | 12.0 |
| Flocculating agent I | — | — | — | 0.3 |
| Glycerol | — | — | — | 0.6 |
| Wax | — | — | — | 0.4 |
| Misc/minors to 100% | | | | |
| Density in g/litre | 850 | 850 | 850 | 850 |

Example 2

The following granular laundry detergent compositions of particular utility under European machine wash conditions are in accord with the invention:

| | A | B | C | D | E | F |
|---|---|---|---|---|---|---|
| LAS | 5.5 | 7.5 | 5.0 | 5.0 | 6.0 | 7.0 |
| TAS | 1.25 | 1.86 | — | 0.8 | 0.4 | 0.3 |
| C24AS/C25AS | — | 2.24 | 5.0 | 5.0 | 5.0 | 2.2 |
| C25E3S | — | 0.76 | 1.0 | 1.5 | 3.0 | 1.0 |
| C45E7 | 3.25 | — | — | — | — | 3.0 |
| TFAA | — | — | 2.0 | — | — | — |
| C25E5 | — | 5.5 | — | — | — | — |
| QAS | 0.8 | — | — | — | — | — |
| QAS II | — | 0.7 | 1.0 | 0.5 | 1.0 | 0.7 |
| STPP | 19.7 | — | — | — | — | — |
| Zeolite A | — | 19.5 | 25.0 | 19.5 | 20.0 | 17.0 |
| NaSKS-6/citric acid (79:21) | — | 10.6 | — | 10.6 | — | — |
| NaSKS-6 | — | — | 9.0 | — | 10.0 | 10.0 |

-continued

| | A | B | C | D | E | F |
|---|---|---|---|---|---|---|
| Carbonate | 6.1 | 10.0 | 9.0 | 10.0 | 10.0 | 18.0 |
| Bicarbonate | — | 2.0 | 7.0 | 5.0 | — | 2.0 |
| Silicate | 6.8 | — | — | 0.3 | 0.5 | — |
| Citrate | — | — | 4.0 | 4.0 | — | — |
| Sulfate | 39.8 | — | — | 5.0 | — | 12.0 |
| Mg sulfate | — | — | 0.1 | 0.2 | 0.2 | — |
| MA/AA | 0.5 | 1.6 | 3.0 | 4.0 | 1.0 | 1.0 |
| CMC | 0.2 | 0.4 | 1.0 | 1.0 | 0.4 | 0.4 |
| PB4 | 5.0 | 12.7 | — | — | — | — |
| Percarbonate | — | — | — | — | 18.0 | 15.0 |
| TAED | 0.5 | 3.1 | — | — | 5.0 | — |
| NAC-OBS | 1.0 | 3.5 | — | — | — | 2.5 |
| DTPMP | 0.25 | 0.2 | 0.3 | 0.4 | — | 0.2 |
| HEDP | — | 0.3 | — | 0.3 | 0.3 | 0.3 |
| QEA | — | — | 1.0 | 1.0 | 1.0 | — |
| Protease I | — | — | — | 0.5 | 1.2 | — |
| Protease | 0.26 | 0.85 | 0.9 | 1.0 | — | 0.7 |
| Lipase (1) | 0.15 | 0.15 | 0.3 | 0.3 | 0.3 | 0.2 |
| Cellulase | 0.28 | 0.28 | 0.2 | 0.2 | 0.3 | 0.3 |
| Amylase | 0.1 | 0.1 | 0.4 | 0.4 | 0.6 | 0.2 |
| PVNO/PVPVI | — | — | 0.2 | 0.2 | — | — |
| PVP | 0.9 | 1.3 | — | — | — | 0.9 |
| SRP 1 | — | — | 0.2 | 0.2 | 0.2 | — |
| Photoactivated bleach (1) (ppm) | 15 ppm | 27 ppm | — | — | 20 ppm | 20 ppm |
| Photoactivated bleach (2) (ppm) | 15 ppm | — | — | — | — | — |
| Brightener 1 | 0.08 | 0.19 | — | — | 0.09 | 0.15 |
| Brightener 2 | — | 0.04 | — | — | — | — |
| Perfume | 0.3 | 0.3 | 0.04 | 0.0 | 0.0 | 0.3 |
| CAP4 | 2.0 | 1.0 | 4.0 | — | — | 0.1 |
| CAP3 | — | — | — | 2.0 | 1.5 | 0.4 |
| Silicone antifoam | 0.5 | 2.4 | 0.3 | 0.5 | 0.3 | 2.0 |
| Minors/misc to 100% | | | | | | |
| Density in g/litre | 750 | 750 | 750 | 750 | 750 | 750 |

Example 3

The following detergent formulations of particular utility under European machine wash conditions were prepared in accord with the invention.

| | A | B | C | D |
|---|---|---|---|---|
| Blown powder | | | | |
| LAS | 6.0 | 5.0 | 11.0 | 6.0 |
| TAS | 2.0 | — | — | 2.0 |
| Zeolite A | 24.0 | — | — | 20.0 |
| STPP | — | 27.0 | 24.0 | — |
| Sulfate | 4.0 | 6.0 | 13.0 | — |
| MA/AA | 1.0 | 4.0 | 6.0 | 2.0 |
| Silicate | 1.0 | 7.0 | 3.0 | 3.0 |
| CMC | 1.0 | 1.0 | 0.5 | 0.6 |
| Brightener 1 | 0.2 | 0.2 | 0.2 | 0.2 |
| Silicone antifoam | 1.0 | 1.0 | 1.0 | 0.3 |
| DTPMP | 0.4 | 0.4 | 0.2 | 0.4 |
| Spray on | | | | |
| Brightener | 0.02 | — | — | 0.02 |
| C45E7 | — | — | — | 5.0 |
| C45E2 | 2.5 | 2.5 | 2.0 | — |
| C45E3 | 2.6 | 2.5 | 2.0 | — |
| Perfume | 0.5 | 0.3 | 0.1 | — |
| Silicone antifoam | 0.3 | 0.3 | 0.3 | — |

-continued

| | A | B | C | D |
|---|---|---|---|---|
| Dry additives | | | | |
| QEA | — | — | — | 1.0 |
| EDDS | 0.3 | — | — | — |
| Sulfate | 2.0 | 3.0 | 5.0 | 10.0 |
| Carbonate | 6.0 | 13.0 | 11.0 | 14.0 |
| Citric acid | 2.5 | — | — | 2.0 |
| QAS II | 0.5 | — | — | 0.5 |
| SKS-6 | 10.0 | — | — | — |
| Percarbonate | 18.5 | — | — | — |
| PB4 | — | 18.0 | 10.0 | 21.5 |
| TAED | 2.0 | 2.0 | — | 2.0 |
| NAC-OBS | 3.0 | 2.0 | 4.0 | — |
| Protease | 1.0 | 1.0 | 1.0 | 1.0 |
| Lipase | — | 0.4 | — | 0.2 |
| Lipase (1) | 0.4 | — | 0.4 | — |
| Amylase | 0.2 | 0.2 | 0.2 | 0.4 |
| Brightener 1 | 0.05 | — | — | 0.05 |
| CAP3 | 1.2 | 1.5 | 2.0 | 0.1 |
| Misc/minor to 100% | | | | |

Example 4

The following granular detergent formulations were prepared in accord with the invention.

| | A | B | C | D | E | F |
|---|---|---|---|---|---|---|
| Blown powder | | | | | | |
| LAS | 23.0 | 8.0 | 7.0 | 9.0 | 7.0 | 7.0 |
| TAS | — | — | — | — | 1.0 | — |
| C45AS | 6.0 | 6.0 | 5.0 | 8.0 | — | — |
| C45AES | — | 1.0 | 1.0 | 1.0 | — | — |
| C45E35 | — | — | — | — | 2.0 | 4.0 |
| Zeolite A | 10.0 | 18.0 | 14.0 | 12.0 | 10.0 | 10.0 |
| MA/AA | — | 0.5 | — | — | — | 2.0 |
| MA/AA (1) | 7.0 | — | — | — | — | — |
| AA | — | 3.0 | 3.0 | 2.0 | 3.0 | 3.0 |
| Sulfate | 5.0 | 6.3 | 14.3 | 11.0 | 15.0 | 19.3 |
| Silicate | 10.0 | 1.0 | 1.0 | 1.0 | 1.0 | 1.0 |
| Carbonate | 13.0 | 19.0 | 8.0 | 20.7 | 8.0 | 6.0 |
| PEG 4000 | 0.4 | 1.5 | 1.5 | 1.0 | 1.0 | 1.0 |
| DTPA | — | 0.9 | 0.5 | — | — | 0.5 |
| Brightener 2 | 0.3 | 0.2 | 0.3 | — | 0.1 | 0.3 |
| Spray on | | | | | | |
| C45E7 | — | 2.0 | — | — | 2.0 | 2.0 |
| C25E9 | 3.0 | — | — | — | — | — |
| C23E9 | — | — | 1.5 | 2.0 | — | 2.0 |
| Perfume | 0.3 | 0.3 | 0.3 | 2.0 | 0.03 | — |
| Agglomerates | | | | | | |
| C45AS | — | 5.0 | 5.0 | 2.0 | — | 5.0 |
| LAS | — | 2.0 | 2.0 | — | — | 2.0 |
| Zeolite A | — | 7.5 | 7.5 | 8.0 | — | 7.5 |
| Carbonate | — | 4.0 | 4.0 | 5.0 | — | 4.0 |
| PEG 4000 | — | 0.5 | 0.5 | — | — | 0.5 |
| Misc (water etc) | — | 2.0 | 2.0 | 2.0 | — | 2.0 |
| Dry additives | | | | | | |
| QAS (I) | — | — | — | — | 1.0 | — |
| Citric acid | — | — | — | — | 2.0 | — |
| PB4 | — | — | — | — | 12.0 | 1.0 |
| PB1 | 4.0 | 1.0 | 3.0 | 2.0 | — | — |
| Percarbonate | — | — | — | — | 2.0 | 10.0 |
| Carbonate | — | 5.3 | 1.8 | — | 4.0 | 4.0 |
| NOBS | 4.0 | — | 6.0 | — | — | 0.6 |

-continued

| | | | | | | |
|---|---|---|---|---|---|---|
| Methyl cellulose | 0.2 | — | — | — | — | — |
| SKS-6 | 8.0 | — | — | — | — | — |
| STS | — | — | 2.0 | — | 1.0 | — |
| Cumene sulfonic acid | — | 1.0 | — | — | — | 2.0 |
| Lipase | 0.2 | — | 0.2 | — | 0.2 | 0.4 |
| Cellulase | 0.2 | 0.2 | 0.2 | 0.3 | 0.2 | 0.2 |
| Amylase | 0.2 | — | 0.1 | — | 0.2 | — |
| Protease | 0.5 | 0.5 | 0.5 | 0.3 | 0.5 | 0.5 |
| PVPVI | — | — | — | — | 0.5 | 0.1 |
| PVP | — | — | — | — | 0.5 | — |
| PVNO | — | — | 0.5 | 0.3 | — | — |
| QEA | — | — | — | — | 1.0 | — |
| SRP1 | 0.2 | 0.5 | 0.3 | — | 0.2 | — |
| CAP3 | 1.2 | 1.0 | 3.0 | 1.5 | 0.06 | 0.1 |
| Silicone antifoam | 0.2 | 0.4 | 0.2 | 0.4 | 0.1 | — |
| Mg sulfate | — | — | 0.2 | — | 0.2 | — |
| Misc/minors to 100% | | | | | | |

| | G | H | I | J |
|---|---|---|---|---|
| Blown powder | | | | |
| Clay I or II | 7.0 | 10.0 | 6.0 | 2.0 |
| LAS | 16.0 | 5.0 | 11.0 | 6.0 |
| TAS | — | 5.0 | — | 2.0 |
| Zeolite A | — | 20.0 | — | 10.0 |
| STPP | 24.0 | — | 14.0 | — |
| Sulfate | — | 2.0 | — | — |
| MA/AA | — | 2.0 | 1.0 | 1.0 |
| Silicate | 4.0 | 7.0 | 3.0 | — |
| CMC | 1.0 | — | 0.5 | 0.6 |
| Brightener 1 | 0.2 | 0.2 | 0.2 | 0.2 |
| Carbonate | 10.0 | 10.0 | 20.0 | — |
| DTPMP | 0.4 | 0.4 | 0.2 | — |
| Spray on | | | | |
| Brightener 1 | 0.02 | — | — | 0.02 |
| C45E7 or E9 | — | — | 2.0 | 1.0 |
| C45E3 or E4 | — | — | 2.0 | 4.0 |
| Perfume | 0.5 | — | 0.5 | 0.2 |
| Silicone antifoam | 0.3 | — | — | — |
| Dry additives | | | | |
| Flocculating agent I or II | 0.3 | 1.0 | 1.0 | 0.5 |
| QEA | — | — | — | 1.0 |
| HEDP/EDDS | 0.3 | — | — | — |
| Sulfate | 2.0 | — | — | — |
| Carbonate | 20.0 | 13.0 | 15.0 | 24.0 |
| Citric acid | 2.5 | — | — | 2.0 |
| QAS | — | — | 0.5 | 0.5 |
| NaSKS-6 | 3.5 | — | — | 5.0 |
| Percarbonate | — | — | — | 9.0 |
| PB4 | — | — | 5.0 | |
| NOBS | — | — | — | 1.3 |
| TAED | — | — | 2.0 | 1.5 |
| Protease | 1.0 | 1.0 | 1.0 | 1.0 |
| Lipase | — | 0.4 | — | 0.2 |
| Amylase | 0.2 | 0.2 | 0.2 | 0.4 |
| Brightener 2 | 0.05 | — | — | 0.05 |
| Perfume | — | 0.2 | 0.5 | 0.3 |
| Speckle | 1.2 | 0.5 | 2.0 | — |
| CAP1 | 1.0 | 0.5 | 1.4 | 2.0 |
| Misc/minor to 100% | | | | |

Example 5

The following nil bleach-containing detergent formulations of particular use in the washing of coloured clothing, according to the present invention were prepared:

| | A | B | C |
|---|---|---|---|
| Blown Powder | | | |
| Zeolite A | 15.0 | 15.0 | — |
| Sulfate | 0.0 | 5.0 | — |
| LAS | 3.0 | 3.0 | — |
| DTPMP | 0.4 | 0.5 | — |
| CMC | 0.4 | 0.4 | — |
| MA/AA | 4.0 | 4.0 | — |
| Agglomerates | | | |
| C45AS | — | — | 11.0 |
| LAS | 6.0 | 5.0 | — |
| TAS | 3.0 | 2.0 | — |
| Silicate | 4.0 | 4.0 | — |
| Zeolite A | 10.0 | 15.0 | 13.0 |
| CMC | — | — | 0.5 |
| MA/AA | — | — | 2.0 |
| Carbonate | 9.0 | 7.0 | 7.0 |
| Spray On | | | |
| Perfume | 0.3 | 0.3 | 0.5 |
| C45E7 | 4.0 | 4.0 | 4.0 |
| C25E3 | 2.0 | 2.0 | 2.0 |
| Dry additives | | | |
| MA/AA | — | — | 3.0 |
| NaSKS-6 | — | — | 12.0 |
| Citrate | 10.0 | — | 8.0 |
| Bicarbonate | 7.0 | 3.0 | 5.0 |
| Carbonate | 6.0 | — | 7.0 |
| PVPVI/PVNO | 0.5 | 0.5 | 0.5 |
| Alcalase | 0.5 | 0.3 | 0.9 |
| Lipase | 0.4 | 0.4 | 0.4 |
| Amylase | 0.6 | 0.6 | 0.6 |
| Cellulase | 0.6 | 0.6 | 0.6 |
| CAP2 | 3.0 | 2.0 | 0.45 |
| Silicone antifoam | 5.0 | 5.0 | 5.0 |
| Sulfate | 0.0 | 9.0 | 0.0 |
| Misc/minors to 100% | 100.0 | 100.0 | 100.0 |
| Density (g/litre) | 700 | 700 | 700 |

Example 6

The following granular detergent formulations were prepared in accord with the invention.

| | A | B | C | D |
|---|---|---|---|---|
| Base granule | | | | |
| Zeolite A | 30.0 | 22.0 | 24.0 | 10.0 |
| Sulfate | 10.0 | 5.0 | 10.0 | 7.0 |
| MA/AA | 3.0 | — | — | — |
| AA | — | 1.6 | 2.0 | — |
| MA/AA (1) | — | 12.0 | — | 6.0 |
| LAS | 14.0 | 10.0 | 9.0 | 20.0 |
| C45AS | 8.0 | 7.0 | 9.0 | 7.0 |
| C45AES | — | 1.0 | 1.0 | — |
| Silicate | — | 1.0 | 0.5 | 10.0 |
| Soap | — | 2.0 | — | — |
| Brightener 1 | 0.2 | 0.2 | 0.2 | 0.2 |
| Carbonate | 6.0 | 9.0 | 10.0 | 10.0 |
| PEG 4000 | — | 1.0 | 1.5 | — |
| DTPA | — | 0.4 | — | — |
| Spray on | | | | |
| C25E9 | — | — | — | 5.0 |
| C45E7 | 1.0 | 1.0 | — | — |
| C23E9 | — | 1.0 | 2.5 | — |
| Perfume | 0.2 | 0.3 | 0.3 | — |

-continued

| | A | B | C | D |
|---|---|---|---|---|
| Dry additives | | | | |
| Carbonate | 5.0 | 5.0 | 15.0 | 6.0 |
| PVPVI/PVNO | 0.5 | — | 0.3 | — |
| Protease | 1.0 | 1.0 | 1.0 | 0.5 |
| Lipase | 0.4 | — | — | 0.4 |
| Amylase | 0.1 | — | — | 0.1 |
| Cellulase | 0.1 | 0.2 | 0.2 | 0.1 |
| NOBS | — | 4.0 | — | 4.5 |
| PB1 | 1.0 | 5.0 | 1.5 | 6.0 |
| Sulfate | 4.0 | 5.0 | — | 5.0 |
| SRPI | — | 0.4 | — | — |
| CAP2 | 5.0 | 2.0 | 0.4 | 0.1 |
| CAP3 | — | — | — | 0.1 |
| Sud supressor | — | 0.5 | 0.5 | — |
| Misc/minor to 100% | | | | |

Example 7

The following granular detergent compositions were prepared in accord with the invention.

| | A | B | C |
|---|---|---|---|
| Blown powder | | | |
| Zeolite A | 20.0 | — | 15.0 |
| STPP | — | 20.0 | — |
| Sulphate | — | — | 5.0 |
| Carbonate | — | — | 5.0 |
| TAS | — | — | 1.0 |
| LAS | 6.0 | 6.0 | 6.0 |
| C68AS | 2.0 | 2.0 | — |
| Silicate | 3.0 | 8.0 | — |
| MA/AA | 4.0 | 2.0 | 2.0 |
| CMC | 0.6 | 0.6 | 0.2 |
| Brightener 1 | 0.2 | 0.2 | 0.1 |
| DTPMP | 0.4 | 0.4 | 0.1 |
| STS | — | — | 1.0 |
| Spray on | | | |
| C45E7 | 5.0 | 5.0 | 4.0 |
| Silicone antifoam | 0.3 | 0.3 | 0.1 |
| Perfume | 0.2 | 0.2 | 0.3 |
| Dry additives | | | |
| QEA | — | — | 1.0 |
| Carbonate | 14.0 | 9.0 | 10.0 |
| PB1 | 1.5 | 2.0 | — |
| PB4 | 18.5 | 13.0 | 13.0 |
| TAED | 2.0 | 2.0 | 2.0 |
| QAS (I) | — | — | 1.0 |
| Photoactivated bleach | 15 ppm | 15 ppm | 15 ppm |
| SKS-6 | — | — | 3.0 |
| Protease | 1.0 | 1.0 | 0.2 |
| Lipase | 0.2 | 0.2 | 0.2 |
| Amylase | 0.4 | 0.4 | 0.2 |
| Cellulase | 0.1 | 0.1 | 0.2 |
| Sulfate | 10.0 | 20.0 | 5.0 |
| CAP1 | 1.2 | 2.0 | 0.5 |
| Misc/minors to 100% | | | |
| Density (g/litre) | 700 | 700 | 700 |

Example 8

The following detergent compositions, according to the present invention were prepared:

| | A | B | C |
|---|---|---|---|
| Blown Powder | | | |
| Zeolite A | 15.0 | 15.0 | 15.0 |
| Sulfate | 0.0 | 5.0 | 0.0 |
| LAS | 3.0 | 3.0 | 3.0 |
| QAS | — | 1.5 | 1.5 |
| DTPMP | 0.4 | 0.2 | 0.4 |
| EDDS | — | 0.4 | 0.2 |
| CMC | 0.4 | 0.4 | 0.4 |
| MA/AA | 4.0 | 2.0 | 2.0 |
| Agglomerates | | | |
| LAS | 5.0 | 5.0 | 5.0 |
| TAS | 2.0 | 2.0 | 1.0 |
| Silicate | 3.0 | 3.0 | 4.0 |
| Zeolite A | 8.0 | 8.0 | 8.0 |
| Carbonate | 8.0 | 8.0 | 4.0 |
| Spray On | | | |
| Perfume | 0.3 | 0.3 | 0.3 |
| C45E7 | 2.0 | 2.0 | 2.0 |
| C25E3 | 2.0 | — | — |
| Dry additives | | | |
| Citrate | 5.0 | — | 2.0 |
| Bicarbonate | — | 3.0 | — |
| Carbonate | 8.0 | 15.0 | 10.0 |
| TAED | 6.0 | 2.0 | 5.0 |
| PB1 | 14.0 | 7.0 | 10.0 |
| PEO | — | — | 0.2 |
| CAP1 | 1.2 | 1.0 | 0.75 |
| Bentonite clay | — | — | 10.0 |
| Protease | 1.0 | 1.0 | 1.0 |
| Lipase | 0.4 | 0.4 | 0.4 |
| Amylase | 0.6 | 0.6 | 0.6 |
| Cellulase | 0.6 | 0.6 | 0.6 |
| Silicone antifoam | 5.0 | 5.0 | 5.0 |
| Sodium sulfate | 0.0 | 3.0 | 0.0 |
| Misc/minors to 100% | 100.0 | 100.0 | 100.0 |
| Density (g/litre) | 850 | 850 | 850 |

| | D | E | F | G | H |
|---|---|---|---|---|---|
| Blown Powder | | | | | |
| STPP/Zeolite A | 9.0 | 15.0 | 15.0 | 9.0 | 9.0 |
| Flocculating agent II or III | 0.5 | 0.2 | 0.9 | 1.5 | — |
| LAS | 7.5 | 23.0 | 3.0 | 7.5 | 7.5 |
| QAS | 2.5 | 1.5 | — | — | — |
| DTPMP | 0.4 | 0.2 | 0.4 | 0.4 | 0.4 |
| HEDP or EDDS | — | 0.4 | 0.2 | — | — |
| CMC | 0.1 | 0.4 | 0.4 | 0.1 | 0.1 |
| Sodium carbonate | 5.0 | 20.0 | 20.0 | 10.0 | — |
| Brightener | 0.05 | — | — | 0.05 | 0.05 |
| Clay I or II | — | 10.0 | — | — | — |
| STS | 0.5 | — | — | 0.5 | 0.5 |
| MA/AA | 1.5 | 2.0 | 2.0 | 1.5 | 1.5 |
| Agglomerates | | | | | |
| Suds suppresser (silicon) | 1.0 | 1.0 | — | 2.0 | 0.5 |
| Agglomerate | | | | | |
| Clay | 9.0 | — | — | 4.0 | 10.0 |
| Wax | 0.5 | — | — | 0.5 | 1.5 |
| Glycerol | 0.5 | — | — | 0.5 | 0.5 |
| Agglomerate | | | | | |
| LAS | — | 5.0 | 5.0 | — | — |
| TAS | — | 2.0 | 1.0 | — | — |
| Silicate | — | 3.0 | 4.0 | — | — |
| Zeolite A | — | 8.0 | 8.0 | — | — |
| Carbonate | — | 8.0 | 4.0 | — | — |

-continued

| | | | | | |
|---|---|---|---|---|---|
| Spray On | | | | | |
| Perfume | 0.3 | — | — | 0.3 | 0.3 |
| C45E7 or E9 | 2.0 | — | — | 2.0 | 2.0 |
| C25E3 or E4 | 2.0 | — | — | 2.0 | 2.0 |
| Dry additives | | | | | |
| Citrate or citric acid | 2.5 | — | 2.0 | 2.5 | 2.5 |
| Clay I or II | — | 5.0 | 5.0 | — | — |
| Flocculating agent I or II | — | — | — | — | 0.2 |
| Bicarbonate | — | 3.0 | — | — | — |
| Carbonate | 15.0 | — | — | 25.0 | 31.0 |
| TAED | 1.0 | 2.0 | 5.0 | 1.0 | — |
| Sodium perborate or percarbonate | 6.0 | 7.0 | 10.0 | 6.0 | — |
| SRP1, 2, 3 or 4 | 0.2 | 0.1 | 0.2 | 0.5 | 0.3 |
| CMC or nonionic cellulose ether | 1.0 | 1.5 | 0.5 | — | — |
| Protease | 0.3 | 1.0 | 1.0 | 0.3 | 0.3 |
| Lipase | — | 0.4 | 0.4 | — | — |
| Amylase | 0.2 | 0.6 | 0.6 | 0.2 | 0.2 |
| Cellulase | 0.2 | 0.6 | 0.6 | 0.2 | 0.2 |
| Silicone antifoam | — | 5.0 | 5.0 | — | — |
| Perfume (starch) | 0.2 | 0.3 | 1.0 | 0.2 | 0.2 |
| Speckle | 0.5 | 0.5 | 0.1 | — | 1.0 |
| NaSKS-6 (silicate 2R) | 3.5 | — | — | — | 3.5 |
| Photobleach | 0.1 | — | — | 0.1 | 0.1 |
| Soap | 0.5 | 2.5 | — | 0.5 | 0.5 |
| Sodium sulfate | — | 3.0 | — | — | — |
| CAP5 | 0.7 | 1.0 | 2.0 | 0.4 | 1.5 |
| Misc/minors to 100% | 100.0 | 100.0 | 100.0 | 100.0 | 100.0 |
| Density (g/litre) | 850 | 850 | 850 | 850 | 850 |

Example 9

The following detergent formulations, according to the present invention were prepared:

| | A | B | C | D |
|---|---|---|---|---|
| LAS | 18.0 | 14.0 | 24.0 | 20.0 |
| QAS | 0.7 | 1.0 | — | 0.7 |
| TFAA | — | 1.0 | — | — |
| C23E56.5 | — | — | 1.0 | — |
| C45E7 | — | 1.0 | — | — |
| C45E3S | 1.0 | 2.5 | 1.0 | — |
| STPP | 32.0 | 18.0 | 30.0 | 22.0 |
| Silicate | 9.0 | 5.0 | 9.0 | 8.0 |
| Carbonate | 9.0 | 7.5 | — | 5.0 |
| Bicarbonate | — | 7.5 | — | — |
| PB1 | 3.0 | 1.0 | — | — |
| PB4 | — | 1.0 | — | — |
| NOBS | 2.0 | 1.0 | — | — |
| DTPMP | — | 1.0 | — | — |
| DTPA | 0.5 | — | 0.2 | 0.3 |
| SRP 1 | 0.3 | 0.2 | — | 0.1 |
| MA/AA | 1.0 | 1.5 | 2.0 | 0.5 |
| CMC | 0.8 | 0.4 | 0.4 | 0.2 |
| PEI | — | — | 0.4 | — |
| Sodium sulfate | 20.0 | 10.0 | 20.0 | 30.0 |
| Mg sulfate | 0.2 | — | 0.4 | 0.9 |
| Protease | 0.8 | 1.0 | 0.5 | 0.5 |
| Amylase | 0.5 | 0.4 | — | 0.25 |
| Lipase | 0.2 | — | 0.1 | — |
| Cellulase | 0.15 | — | — | 0.05 |
| Photoactivated bleach (ppm) | 30 ppm | 20 ppm | — | 10 ppm |
| CAP2 | 2.0 | 1 | 0.8 | 2 |
| Perfume spray on | 0.3 | 0.3 | 0.1 | — |
| Brightener ½ | 0.05 | 0.2 | 0.08 | 0.1 |
| Misc/minors to 100% | | | | |

Example 10

The following is a composition in the form of a tablet, bar, extrudate or granule in accord with the invention

| | A | B | C | D | E | F | G |
|---|---|---|---|---|---|---|---|
| Sodium $C_{11}$-$C_{13}$ alkylbenzenesulfonate | 12.0 | 16.0 | 23.0 | 19.0 | 18.0 | 20.0 | 16.0 |
| Sodium $C_{14}$-$C_{15}$ alcohol sulfate | | 4.5 | — | | — | — | 4.0 |
| $C_{14}$-$C_{15}$ alcohol ethoxylate (3) sulfate | — | — | 2.0 | — | 1.0 | 1.0 | 1.0 |
| Sodium $C_{14}$-$C_{15}$ alcohol ethoxylate | 2.0 | 2.0 | — | 1.3 | — | — | 5.0 |
| $C_9$-$C_{14}$ alkyl dimethyl hydroxy ethyl quaternary ammonium salt | | | — | — | 1.0 | 0.5 | 2.0 |
| Tallow fatty acid | | | — | — | — | — | 1.0 |
| Sodium tripolyphosphate/ Zeolite | 23.0 | 25.0 | 14.0 | 22.0 | 20.0 | 10.0 | 20.0 |
| Sodium carbonate | 25.0 | 22.0 | 35.0 | 20.0 | 28.0 | 41.0 | 30.0 |
| Sodium Polyacrylate (45%) | 0.5 | 0.5 | 0.5 | 0.5 | — | — | — |
| Sodium polyacrylate/ maleate polymer | — | — | 1.0 | 1.0 | 1.0 | 2.0 | 0.5 |
| Sodium silicate (1:6 ratio NaO/$SiO_2$) (46%) | 3.0 | 6.0 | 9.0 | 8.0 | 9.0 | 6.0 | 8.0 |
| Sodium sulfate | — | — | — | — | — | 2.0 | 3.0 |
| Sodium perborate/ percarbonate | 5.0 | 5.0 | 10.0 | — | 3.0 | 1.0 | — |
| Poly(ethyleneglycol), MW ~4000 (50%) | 1.5 | 1.5 | 1.0 | 1.0 | — | — | 0.5 |
| Sodium carboxy methyl cellulose | 1.0 | 1.0 | 1.0 | — | 0.5 | 0.5 | 0.5 |
| NOBS/DOBS | — | 1.0 | — | — | 1.0 | 0.7 | — |
| TAED | 1.5 | 1.0 | 2.5 | — | 3.0 | 0.7 | — |
| SRP 1 | 1.5 | 1.5 | 1.0 | 1.0 | — | 1.0 | — |
| Clay I or II | 5.0 | 6.0 | 12.0 | 7.0 | 10.0 | 4.0 | 3.0 |
| Flocculating agent I or III | 0.2 | 0.2 | 3.0 | 2.0 | 0.1 | 1.0 | 0.5 |
| Humectant | 0.5 | 1.0 | 0.5 | 1.0 | 0.5 | 0.5 | — |
| Wax | 0.5 | 0.5 | 1.0 | — | — | 0.5 | 0.5 |
| Moisture | 7.5 | 7.5 | 6.0 | 7.0 | 5.0 | 3.0 | 5.0 |
| Magnesium sulphate | — | — | — | — | — | 0.5 | 1.5 |
| Chelant | — | — | — | — | 0.8 | 0.6 | 1.0 |
| Enzymes, including amylase, cellulase, protease and lipase | — | — | — | — | 2.0 | 1.5 | 2.0 |
| Speckle | 2.5 | 4.1 | 4.2 | 4.4 | 5.6 | 5.0 | 5.2 |
| minors, e.g. perfume, PVP, PVPVI/PVNO, brightener, photo-bleach, | 2.0 | 1.0 | 1.0 | 1.0 | 2.5 | 1.5 | 1.0 |
| CAP2 | 1.6 | 2.0 | 0.4 | 2.0 | 1.0 | 1.6 | 0.5 |

| | H | I | J | K |
|---|---|---|---|---|
| Sodium $C_{11}$-$C_{13}$ alkylbenzenesulfonate | 23.0 | 13.0 | 20.0 | 18.0 |
| Sodium $C_{14}$-$C_{15}$ alcohol sulfate | — | 4.0 | — | — |
| Clay I or II | 5.0 | 10.0 | 14.0 | 6.0 |
| Flocculating agent I or II | 0.2 | 0.3 | 0.1 | 0.9 |
| Wax | 0.5 | 0.5 | 1.0 | — |
| Humectant (glycerol/silica) | 0.5 | 2.0 | 1.5 | — |
| $C_{14}$-$C_{15}$ alcohol ethoxylate sulfate | — | | — | 2.0 |
| Sodium $C_{14}$-$C_{15}$ alcohol ethoxylate | 2.5 | 3.5 | — | — |
| ($C_9$-$C_{14}$ alkyl dimethyl hydroxy ethyl quaternary ammonium salt | | — | — | 0.5 |
| Tallow fatty acid | 0.5 | — | — | — |
| Tallow alcohol ethoxylate (50) | — | — | | 1.3 |
| Sodium tripolyphosphate | — | 41.0 | — | 20.0 |
| Zeolite A, hydrate (0.1-10 micrometer size) | 26.3 | — | 21.3 | — |
| Sodium carbonate | 24.0 | 22.0 | 35.0 | 27.0 |
| Sodium Polyacrylate (45%) | 2.4 | — | 2.7 | — |

-continued

| | | | | |
|---|---|---|---|---|
| Sodium polyacrylate/maleate polymer | — | — | 1.0 | 2.5 |
| Sodium silicate (1.6 or 2 or 2.2 ratio $NaO/SiO_2$)(46%) | 4.0 | 7.0 | 2.0 | 6.0 |
| Sodium sulfate | — | 6.0 | 2.0 | — |
| Sodium perborate/percarbonate | 8.0 | 4.0 | — | 12.0 |
| Poly(ethyleneglycol), MW ~4000 (50%) | 1.7 | 0.4 | 1.0 | — |
| Sodium carboxy methyl cellulose | 1.0 | — | — | 0.3 |
| Citric acid | — | — | 3.0 | — |
| NOBS/DOBS | 1.2 | — | — | 1.0 |
| TAED | 0.6 | 1.5 | — | 3.0 |
| Perfume | 0.5 | 1.0 | 0.3 | 0.4 |
| SRP 1 | — | 1.5 | 1.0 | 1.0 |
| Moisture | 7.5 | 3.1 | 6.1 | 7.3 |
| Magnesium sulphate | — | — | — | 1.0 |
| Chelant | — | — | — | 0.5 |
| speckle | 1.0 | 0.5 | 0.2 | 2.7 |
| Enzymes, including amylase, cellulase, protease and lipase | — | 1.0 | — | 1.5 |
| minors, e.g. brightener, photo-bleach | 1.0 | 1.0 | 1.0 | 1.0 |
| CAP2 | 1.2 | 0.4 | 1.6 | 2.0 |

Example 11

The following liquid detergent formulations were prepared in accord with the invention (levels are given as parts per weight).

| | A | B | C | D | E |
|---|---|---|---|---|---|
| LAS | 11.5 | 8.8 | — | 3.9 | — |
| C25E2.5S | — | 3.0 | 18.0 | — | 16.0 |
| C45E2.25S | 11.5 | 3.0 | — | 15.7 | — |
| C23E9 | — | 2.7 | 1.8 | 2.0 | 1.0 |
| C23E7 | 3.2 | — | — | — | — |
| CFAA | — | — | 5.2 | — | 3.1 |
| TPKFA | 1.6 | — | 2.0 | 0.5 | 2.0 |
| Citric acid (50%) | 6.5 | 1.2 | 2.5 | 4.4 | 2.5 |
| Calcium formate | 0.1 | 0.06 | 0.1 | — | — |
| Sodium formate | 0.5 | 0.06 | 0.1 | 0.05 | 0.05 |
| Sodium cumene sulfonate | 4.0 | 1.0 | 3.0 | 1.18 | — |
| Borate | 0.6 | — | 3.0 | 2.0 | 2.9 |
| Sodium hydroxide | 5.8 | 2.0 | 3.5 | 3.7 | 2.7 |
| Ethanol | 1.75 | 1.0 | 3.6 | 4.2 | 2.9 |
| 1,2 propanediol | 3.3 | 2.0 | 8.0 | 7.9 | 5.3 |
| Monoethanolamine | 3.0 | 1.5 | 1.3 | 2.5 | 0.8 |
| TEPAE | 1.6 | — | 1.3 | 1.2 | 1.2 |
| Protease | 1.0 | 0.3 | 1.0 | 0.5 | 0.7 |
| Lipase | — | — | 0.1 | — | — |
| Cellulase | — | — | 0.1 | 0.2 | 0.05 |
| Amylase | — | — | — | 0.1 | — |
| SRP1 | 0.2 | — | 0.1 | — | — |
| DTPA | — | — | 0.3 | — | — |
| PVNO | — | — | 0.3 | — | 0.2 |
| CAP1 | 2.0 | — | 0.1 | — | — |
| CAP6 | — | 0.4 | — | — | — |
| CAP7 | — | — | 0.2 | — | 0.1 |
| CAP8 | — | — | — | 0.5 | — |
| Brightener 1 | 0.2 | 0.07 | 0.1 | — | — |
| Silicone antifoam | 0.04 | 0.02 | 0.1 | 0.1 | 0.1 |
| Water/minors up to 100% | | | | | |

Example 12

The following liquid detergent formulations were prepared in accord with the invention (levels are given in parts per weight):

| | A | B | C | D | E | F | G | H |
|---|---|---|---|---|---|---|---|---|
| LAS | 10.0 | 13.0 | 9.0 | — | 25.0 | — | — | — |
| C25AS | 4.0 | 1.0 | 2.0 | 10.0 | — | 13.0 | 18.0 | 15.0 |
| C25E3S | 1.0 | — | — | 3.0 | — | 2.0 | 2.0 | 4.0 |
| C25E7 | 6.0 | 8.0 | 13.0 | 2.5 | — | — | 4.0 | 4.0 |
| TFAA | — | — | — | 4.5 | — | 6.0 | 8.0 | 8.0 |
| APA | — | 1.4 | — | — | 3.0 | 1.0 | 2.0 | — |
| TPKFA | 2.0 | — | 13.0 | 7.0 | — | 15.0 | 11.0 | 11.0 |
| Citric acid | 2.0 | 3.0 | 1.0 | 1.5 | 1.0 | 1.0 | 1.0 | 1.0 |
| Dodecenyl/ tetradecenyl succinic acid | 12.0 | 10.0 | — | — | 15.0 | — | — | — |
| Rape seed fatty acid | 4.0 | 2.0 | 1.0 | — | 1.0 | — | 3.5 | — |
| Ethanol | 4.0 | 4.0 | 7.0 | 2.0 | 7.0 | 2.0 | 3.0 | 2.0 |
| 1,2 Propanediol | 4.0 | 4.0 | 2.0 | 7.0 | 6.0 | 8.0 | 10.0 | 13.0 |
| Monoethanol-amine | — | — | — | 5.0 | — | — | 9.0 | 9.0 |
| Triethanol-amine | — | — | 8.0 | — | — | — | — | — |
| TEPAE | 0.5 | — | 0.5 | 0.2 | — | — | 0.4 | 0.3 |
| DTPMP | 1.0 | 1.0 | 0.5 | 1.0 | 2.0 | 1.2 | 1.0 | — |
| Protease | 0.5 | 0.5 | 0.4 | 0.25 | — | 0.5 | 0.3 | 0.6 |
| Alcalase | — | — | — | — | 1.5 | — | — | — |
| Lipase | — | 0.10 | — | 0.01 | — | — | 0.15 | 0.15 |
| Amylase | 0.25 | 0.25 | 0.6 | 0.5 | 0.25 | 0.9 | 0.6 | 0.6 |
| Cellulase | — | — | — | 0.05 | — | — | 0.15 | 0.15 |
| Endolase | — | — | — | 0.10 | — | — | 0.07 | — |
| SRP2 | 0.3 | — | 0.3 | 0.1 | — | — | 0.2 | 0.1 |
| Boric acid | 0.1 | 0.2 | 1.0 | 2.0 | 1.0 | 1.5 | 2.5 | 2.5 |
| Calcium chloride | — | 0.02 | — | 0.01 | — | — | — | — |
| Bentonite clay | — | — | — | — | 4.0 | 4.0 | — | — |
| Brightener 1 | — | 0.4 | — | — | 0.1 | 0.2 | 0.3 | — |
| Sud supressor | 0.1 | 0.3 | — | 0.1 | 0.4 | — | — | — |
| Opacifier | 0.5 | 0.4 | — | 0.3 | 0.8 | 0.7 | — | — |
| CAP6 | 0.2 | 0.1 | 0.05 | 0.1 | 3.3 | — | — | — |
| CAP7 | — | — | — | 0.1 | — | 0.1 | 0.2 | 0.05 |
| Water/minors up to 100% | | | | | | | | |
| NaOH up to pH | 8.0 | 8.0 | 7.6 | 7.7 | 8.0 | 7.5 | 8.0 | 8.2 |

Example 13

The following liquid detergent compositions were prepared in accord with the invention (levels are given in parts per weight).

| | A | B |
|---|---|---|
| LAS | 27.6 | 18.9 |
| C45AS | 13.8 | 5.9 |
| C13E8 | 3.0 | 3.1 |
| Oleic acid | 3.4 | 2.5 |
| Citric acid | 5.4 | 5.4 |
| Sodium hydroxide | 0.4 | 3.6 |
| Calcium formate | 0.2 | 0.1 |
| Sodium formate | — | 0.5 |
| Ethanol | 7.0 | — |
| Monoethanolamine | 16.5 | 8.0 |
| 1,2 propanediol | 5.9 | 5.5 |
| Xylene sulfonic acid | — | 2.4 |
| TEPAE | 1.5 | 0.8 |
| Protease | 1.5 | 0.6 |
| PEG | — | 0.7 |
| Brightener 2 | 0.4 | 0.1 |
| Perfume | 0.5 | 0.3 |

-continued

| | A | B |
|---|---|---|
| CAP6 | 0.2 | — |
| CAP8 | | |
| Silicone-based suspensding agent | 2.0 | — |
| Water/minors up to 100% | | |

Example 14

The following laundry bar detergent compositions were prepared in accord with the invention (levels are given in parts per weight).

| | A | B | C | D | E | F | G | H |
|---|---|---|---|---|---|---|---|---|
| LAS | — | — | 19.0 | 15.0 | 21.0 | 6.75 | 8.8 | — |
| C28AS | 30.0 | 13.5 | — | — | — | 15.75 | 11.2 | 22.5 |
| Sodium laurate | 2.5 | 9.0 | — | — | — | — | — | — |
| Zeolite A | 2.0 | 1.25 | — | — | — | 1.25 | 1.25 | 1.25 |
| Carbonate | 10.0 | — | 11.0 | 5.0 | 2.0 | 7.0 | 13.0 | 9.0 |
| Calcium carbonate | 27.5 | 39.0 | 35.0 | — | — | 40.0 | — | 40.0 |
| Sulfate | 5.0 | 5.0 | 3.0 | 5.0 | 3.0 | — | — | 5.0 |
| TSPP | 5.0 | — | — | — | — | 5.0 | 2.5 | — |
| STPP | 5.0 | 15.0 | 10.0 | — | — | 7.0 | 8.0 | 10.0 |
| Bentonite clay | — | 10.0 | — | — | 5.0 | — | — | — |
| DTPMP | — | 0.7 | 0.6 | — | 0.6 | 0.7 | 0.7 | 0.7 |
| CMC | — | 1.0 | 1.0 | 1.0 | 1.0 | — | — | 1.0 |
| Talc | — | — | 10.0 | 15.0 | 10.0 | — | — | — |
| Silicate | — | — | 4.0 | 5.0 | 3.0 | — | — | — |
| PVNO | 0.02 | 0.03 | — | 0.01 | — | 0.02 | — | — |
| MA/AA | 0.4 | 1.0 | — | — | 0.2 | 0.4 | 0.5 | 0.4 |
| SRP1 | 0.3 | 0.3 | 0.3 | 0.3 | 0.3 | 0.3 | 0.3 | 0.3 |
| Protease | — | 0.12 | — | 0.08 | 0.08 | — | — | 0.1 |
| Lipase | — | 0.1 | — | 0.1 | — | — | — | — |
| Amylase | — | — | 0.8 | — | — | — | 0.1 | — |
| Cellulase | — | 0.15 | — | — | 0.15 | 0.1 | — | — |

-continued

| | A | B | C | D | E | F | G | H |
|---|---|---|---|---|---|---|---|---|
| PEO | — | 0.2 | — | 0.2 | 0.3 | — | — | 0.3 |
| Perfume | 1.0 | 0.5 | 0.3 | 0.2 | 0.4 | — | — | 0.4 |
| Mg sulfate | — | — | 3.0 | 3.0 | 3.0 | — | — | — |
| CAP1 | 3.0 | 1.4 | 0.8 | 0.4 | 0.1 | 2.0 | 2.0 | 1.0 |
| CAP2 | — | 1.4 | — | — | — | — | 2.0 | — |
| CAP3 | — | — | 0.8 | — | — | — | — | 1.0 |
| CAP4 | — | — | — | 0.4 | 0.1 | — | — | 0.05 |
| Brightener | 0.15 | 0.10 | 0.15 | — | — | — | — | 0.1 |
| Photoactivated bleach (ppm) | — | 15.0 | 15.0 | 15.0 | 15.0 | — | — | 15.0 |

Example 15

The following detergent additive compositions were prepared according to the present invention

| | A | B | C |
|---|---|---|---|
| LAS | — | 5.0 | 5.0 |
| STPP | 30.0 | — | 20.0 |
| Zeolite A | — | 35.0 | 20.0 |
| PB1 | 20.0 | 15.0 | — |
| TAED | 10.0 | 8.0 | — |
| CAP1 | 3.1 | 0.4 | 1.1 |
| CAP2 | — | 0.4 | 0.2 |
| Protease | — | 0.3 | 0.3 |
| Amylase | — | 0.06 | 0.06 |
| Minors, water and miscellaneous | | Up to 100% | |

Example 16

The following compact high density (0.96 Kg/l) dishwashing detergent compositions were prepared according to the present invention

| | A | B | C | D | E | F | G | H |
|---|---|---|---|---|---|---|---|---|
| STPP | — | — | 54.3 | 51.4 | 51.4 | — | — | 50.9 |
| Citrate | 35.0 | 17.0 | — | — | — | 46.1 | 40.2 | — |
| Carbonate | — | 15.0 | 12.0 | 14.0 | 4.0 | — | 7.0 | 31.1 |
| Bicarbonate | — | — | — | — | — | 25.4 | — | — |
| Silicate | 32.0 | 14.8 | 14.8 | 10.0 | 10.0 | 1.0 | 25.0 | 3.1 |
| Metasilicate | — | 2.5 | — | 9.0 | 9.0 | — | — | — |
| PB1 | 1.9 | 9.7 | 7.8 | 7.8 | 7.8 | — | — | — |
| PB4 | 8.6 | — | — | — | — | — | — | — |
| Percarbonate | — | — | — | — | — | 6.7 | 11.8 | 4.8 |
| Nonionic | 1.5 | 2.0 | 1.5 | 1.7 | 1.5 | 2.6 | 1.9 | 5.3 |
| TAED | 5.2 | 2.4 | — | — | — | 2.2 | — | 1.4 |
| HEDP | — | 1.0 | — | — | — | — | — | — |
| DTPMP | — | 0.6 | — | — | — | — | — | — |
| MnTACN | — | — | — | — | — | — | 0.008 | — |
| PAAC | — | — | 0.008 | 0.01 | 0.007 | — | — | — |
| BzP | — | — | — | — | 1.4 | — | — | — |
| Paraffin | 0.5 | 0.5 | 0.5 | 0.5 | 0.5 | 0.6 | — | — |
| CAP1 | 1.2 | 1.4 | 1.2 | 1.1 | — | 0.1 | — | 0.5 |
| CAP2 | — | — | — | — | 2.1 | 2.3 | 4.2 | — |
| Protease | 0.072 | 0.072 | 0.029 | 0.053 | 0.046 | 0.026 | 0.059 | 0.06 |
| Amylase | 0.012 | 0.012 | 0.006 | 0.012 | 0.013 | 0.009 | 0.017 | 0.03 |
| Lipase | — | 0.001 | — | 0.005 | — | — | — | — |
| BTA | 0.3 | 0.3 | 0.3 | 0.3 | 0.3 | — | 0.3 | 0.3 |
| MA/AA | — | — | — | — | — | — | 4.2 | — |
| 480N | 3.3 | 6.0 | — | — | — | — | — | 0.9 |
| Perfume | 0.2 | 0.2 | 0.2 | 0.2 | 0.2 | 0.2 | 0.1 | 0.1 |

-continued

| | A | B | C | D | E | F | G | H |
|---|---|---|---|---|---|---|---|---|
| Sulphate | 7.0 | 20.0 | 5.0 | 2.2 | 0.8 | 12.0 | 4.6 | — |
| pH | 10.8 | 11.0 | 10.8 | 11.3 | 11.3 | 9.6 | 10.8 | 10.9 |
| Miscellaneous and water | | | | Up to 100% | | | | |

Example 17

The following granular dishwashing detergent compositions of bulk density 1.02 Kg/L were prepared according to the present invention:

| | A | B | C | D | E | F | G | H |
|---|---|---|---|---|---|---|---|---|
| STPP | 30.0 | 30.0 | 33.0 | 34.2 | 29.6 | 31.1 | 26.6 | 17.6 |
| Carbonate | 29.5 | 30.0 | 29.0 | 24.0 | 15.0 | 36.0 | 2.1 | 38.0 |
| Silicate | 7.4 | 7.4 | 7.5 | 7.2 | 13.3 | 3.4 | 43.7 | 12.4 |
| Metasilicate | — | — | 4.5 | 5.1 | — | — | — | — |
| Percarbonate | — | — | — | — | — | 4.0 | — | — |
| PB1 | 4.4 | 4.2 | 4.5 | 4.5 | — | — | — | — |
| NADCC | — | — | — | — | 2.0 | — | 1.6 | 1.0 |
| Nonionic | 1.2 | 1.0 | 0.7 | 0.8 | 1.9 | 0.7 | 0.6 | 0.3 |
| TAED | 1.0 | — | — | — | — | 0.8 | — | — |
| PAAC | — | 0.004 | 0.004 | 0.004 | — | — | — | — |
| BzP | — | — | — | 1.4 | — | — | — | — |
| Paraffin | 0.25 | 0.25 | 0.25 | 0.25 | — | — | — | — |
| CAP1 | 1.0 | 0.5 | 1.4 | 1.8 | 0.1 | — | — | — |
| CAP2 | — | — | — | — | 0.1 | 0.15 | 0.2 | 0.1 |
| Protease | 0.036 | 0.015 | 0.03 | 0.028 | — | 0.03 | — | — |
| Amylase | 0.003 | 0.003 | 0.01 | 0.006 | — | 0.01 | — | — |
| Lipase | 0.005 | — | 0.001 | — | — | — | — | — |
| BTA | 0.15 | 0.15 | 0.15 | 0.15 | — | — | — | — |
| Perfume | 0.2 | 0.2 | 0.2 | 0.2 | 0.1 | 0.2 | 0.2 | — |
| Sulphate | 23.4 | 25.0 | 22.0 | 18.5 | 30.1 | 19.3 | 23.1 | 23.6 |
| pH | 10.8 | 10.8 | 11.3 | 11.3 | 10.7 | 11.5 | 12.7 | 10.9 |
| Miscellaneous and water | | | | Up to 100% | | | | |

Example 18

The following tablet detergent compositions were prepared according to the present invention by compression of a granular dishwashing detergent composition at a pressure of 13KN/cm$^2$ using a standard 12 head rotary press:

| | A | B | C | D | E | F |
|---|---|---|---|---|---|---|
| STPP | — | 48.8 | 49.2 | 38.0 | — | 46.8 |
| Citrate | 26.4 | — | — | — | 31.1 | — |
| Carbonate | — | 4.0 | 12.0 | 14.4 | 10.0 | 20.0 |
| Silicate | 26.4 | 14.8 | 15.0 | 12.6 | 17.7 | 2.4 |
| CAP1 | 2.3 | — | — | — | 2.5 | 0.2 |
| CAP2 | — | 0.8 | — | — | — | 0.2 |
| CAP3 | — | — | 1.2 | 1 | — | — |
| Protease | 0.058 | 0.072 | 0.041 | 0.033 | 0.052 | 0.013 |
| Amylase | 0.01 | 0.03 | 0.012 | 0.007 | 0.016 | 0.002 |
| Lipase | 0.005 | — | — | — | — | — |
| PB1 | 1.6 | 7.7 | 12.2 | 10.6 | 15.7 | — |
| PB4 | 6.9 | — | — | — | — | 14.4 |
| Nonionic | 1.5 | 2.0 | 1.5 | 1.65 | 0.8 | 6.3 |
| PAAC | — | — | 0.02 | 0.009 | — | — |
| MnTACN | — | — | — | — | 0.007 | — |
| TAED | 4.3 | 2.5 | — | — | 1.3 | 1.8 |
| HEDP | 0.7 | — | — | 0.7 | — | 0.4 |
| DTPMP | 0.65 | — | — | — | — | — |
| Paraffin | 0.4 | 0.5 | 0.5 | 0.55 | — | — |
| BTA | 0.2 | 0.3 | 0.3 | 0.3 | — | — |

-continued

| | A | B | C | D | E | F |
|---|---|---|---|---|---|---|
| PA30 | 3.2 | — | — | — | — | — |
| MA/AA | — | — | — | — | 4.5 | 0.55 |
| Perfume | — | — | 0.05 | 0.05 | 0.2 | 0.2 |
| Sulphate | 24.0 | 13.0 | 2.3 | — | 10.7 | 3.4 |
| Weight of tablet | 25 g | 25 g | 20 g | 30 g | 18 g | 20 g |
| pH | 10.6 | 10.6 | 10.7 | 10.7 | 10.9 | 11.2 |
| Miscellaneous and water | | | Up to 100% | | | |

Example 19

The following liquid dishwashing detergent compositions of density 1.40 Kg/L were prepared according to the present invention:

| | A | B | C | D |
|---|---|---|---|---|
| STPP | 17.5 | 17.5 | 17.2 | 16.0 |
| Carbonate | 2.0 | — | 2.4 | — |
| Silicate | 5.3 | 6.1 | 14.6 | 15.7 |
| NaOCl | 1.15 | 1.15 | 1.15 | 1.25 |

-continued

| | A | B | C | D |
|---|---|---|---|---|
| Polygen/carbopol | 1.1 | 1.0 | 1.1 | 1.25 |
| Nonionic | — | — | 0.1 | — |
| NaBz | 0.75 | 0.75 | — | — |
| CAP6 | 0.4 | 0.8 | 0.1 | 0.5 |
| NaOH | — | 1.9 | — | 3.5 |
| KOH | 2.8 | 3.5 | 3.0 | — |
| pH | 11.0 | 11.7 | 10.9 | 11.0 |
| Sulphate, miscellaneous and water | | up to 100% | | |

Example 20

The following liquid rinse aid compositions were prepared according to the present invention:

| | A | B | C |
|---|---|---|---|
| Nonionic | 12.0 | — | 14.5 |
| Nonionic blend | — | 64.0 | — |
| Citric | 3.2 | — | 6.5 |
| HEDP | 0.5 | — | — |
| PEG | — | 5.0 | — |
| SCS | 4.8 | — | 7.0 |
| Ethanol | 6.0 | 8.0 | — |
| CAP7 | 3 | — | 1 |
| CAP8 | 3.0 | 0.2 | 0.1 |
| pH of the liquid | 2.0 | 7.5 | / |
| Miscellaneous and water | | Up to 100% | |

Example 21

The following liquid dishwashing compositions were prepared according to the present invention

| | A | B | C | D | E |
|---|---|---|---|---|---|
| C17ES | 28.5 | 27.4 | 19.2 | 34.1 | 34.1 |
| Amine oxide | 2.6 | 5.0 | 2.0 | 3.0 | 3.0 |
| C12 glucose amide | — | — | 6.0 | — | — |
| Betaine | 0.9 | — | — | 2.0 | 2.0 |
| Xylene sulfonate | 2.0 | 4.0 | — | 2.0 | — |
| Neodol C11E9 | — | — | 5.0 | — | — |
| Polyhydroxy fatty acid amide | — | — | — | 6.5 | 6.5 |
| Sodium diethylene penta acetate (40%) | — | — | 0.03 | — | — |
| TAED | — | — | — | 0.06 | 0.06 |
| Sucrose | — | — | — | 1.5 | 1.5 |
| Ethanol | 4.0 | 5.5 | 5.5 | 9.1 | 9.1 |
| Alkyl diphenyl oxide disulfonate | — | — | — | — | 2.3 |
| Ca formate | — | — | — | 0.5 | 1.1 |
| Ammonium citrate | 0.06 | 0.1 | — | — | — |
| Na chloride | — | 1.0 | — | — | — |
| Mg chloride | 3.3 | — | 0.7 | — | — |
| Ca chloride | — | — | 0.4 | — | — |
| Na sulfate | — | — | 0.06 | — | — |
| Mg sulfate | 0.08 | — | — | — | — |
| Mg hydroxide | — | — | — | 2.2 | 2.2 |
| Na hydroxide | — | — | — | 1.1 | 1.1 |
| Hydrogen peroxide | 200 ppm | 0.16 | 0.006 | — | — |
| CAP6 | 0.4 | 1.6 | 1.2 | — | 0.1 |
| CAP7 | — | — | — | 1 | 1 |
| Protease | 0.017 | 0.005 | .0035 | 0.003 | 0.002 |
| Perfume | 0.18 | 0.09 | 0.09 | 0.2 | 0.2 |
| Water and minors | | | Up to 100% | | |

Example 22

The following liquid hard surface cleaning compositions were prepared according to the present invention

| | A | B | C | D | E |
|---|---|---|---|---|---|
| CAP6 | 2.8 | — | 1.6 | 1.0 | 0.4 |
| CAP7 | — | 1.2 | — | 1.0 | 0.5 |
| Amylase | 0.01 | 0.002 | 0.005 | — | — |
| Protease | 0.05 | 0.01 | 0.02 | — | — |
| Hydrogen peroxide | — | — | — | 6.0 | 6.8 |
| Acetyl triethyl citrate | — | — | — | 2.5 | — |
| DTPA | — | — | — | 0.2 | — |
| Butyl hydroxy toluene | — | — | — | 0.05 | — |
| EDTA* | 0.05 | 0.05 | 0.05 | — | — |
| Citric/Citrate | 2.9 | 2.9 | 2.9 | 1.0 | — |
| LAS | 0.5 | 0.5 | 0.5 | — | — |
| C12 AS | 0.5 | 0.5 | 0.5 | — | — |
| C10AS | — | — | — | — | 1.7 |
| C12(E)S | 0.5 | 0.5 | 0.5 | — | — |
| C12,13 E6.5 nonionic | 7.0 | 7.0 | 7.0 | — | — |
| Neodol 23-6.5 | — | — | — | 12.0 | — |
| Dobanol 23-3 | — | — | — | — | 1.5 |
| Dobanol 91-10 | — | — | — | — | 1.6 |
| C25AE1.8S | — | — | — | 6.0 | |
| Na paraffin sulphonate | — | — | — | 6.0 | |
| Perfume | 1.0 | 1.0 | 1.0 | 0.5 | 0.2 |
| Propanediol | — | — | — | 1.5 | |
| Ethoxylated tetraethylene pentaimine | — | — | — | 1.0 | — |
| 2, Butyl octanol | — | — | — | — | 0.5 |
| Hexyl carbitol** | 1.0 | 1.0 | 1.0 | — | — |
| SCS | 1.3 | 1.3 | 1.3 | — | — |
| pH adjusted to | 7-12 | 7-12 | 7-12 | 4 | — |
| Miscellaneous and water | | | Up to 100% | | |

*Na4 ethylenediamine diacetic acid
**Diethylene glycol monohexyl ether

Example 23

The following spray composition for cleaning of hard surfaces and removing household mildew was prepared according to the present invention:

| | |
|---|---|
| CAP6 | 1 |
| Amylase | 0.01 |
| Protease | 0.01 |
| Na octyl sulfate | 2.0 |
| Na dodecyl sulfate | 4.0 |
| Na hydroxide | 0.8 |
| Silicate | 0.04 |
| Butyl carbitol* | 4.0 |
| Perfume | 0.35 |
| Water/minors | up to 100% |

*Diethylene glycol monobutyl ether

Example 24

The following lavatory cleansing block compositions were prepared according to the present invention.

| | A | B | C |
|---|---|---|---|
| C16-18 fatty alcohol/50EO | 70.0 | — | — |
| LAS | — | — | 80.0 |
| Nonionic | — | 1.0 | — |
| Oleoamide surfactant | — | 25.0 | — |

-continued

| | A | B | C |
|---|---|---|---|
| Partially esterified copolymer of vinylmethyl ether and maleic anhydride, viscosity 0.1-0.5 | 5.0 | — | — |
| Polyethylene glycol MW 8000 | — | 38.0 | — |
| Water-soluble K-polyacrylate MW 4000-8000 | — | 12.0 | — |
| Water-soluble Na-copolymer of acrylamide (70%) and acryclic acid (30%) low MW | — | 19.0 | — |
| Na triphosphate | 10.0 | — | — |
| Carbonate | — | — | — |
| CAP6 | 1.0 | 1.2 | — |
| CAP7 | — | — | 0.5 |
| Dye | 2.5 | 1.0 | 1.0 |
| Perfume | 3.0 | — | 7.0 |
| KOH/HCL solution | | pH 6-11 | |

Example 25

The following toilet bowl cleaning composition was prepared according to the present invention.

| | A | B |
|---|---|---|
| C14-15 linear alcohol 7EO | 2.0 | 10.0 |
| Citric acid | 10.0 | 5.0 |
| CAP1 | 2.0 | — |
| CAP7 | 2.0 | 4.0 |
| DTPMP | — | 1.0 |
| Dye | 2.0 | 1.0 |
| Perfume | 3.0 | 3.0 |
| NaOH | pH 6-11 | |
| Water and minors | Up to 100% | |

Example 26

The following fabric softening compositions are in accordance with the present invention

| Component | A | B | C | D | E | F |
|---|---|---|---|---|---|---|
| DTDMAC | — | — | — | — | 4.5 | 15.0 |
| DEQA | 2.6 | 2.9 | 18.0 | 19.0 | — | — |
| Fatty acid | 0.3 | — | 1.0 | — | — | — |
| HCl | 0.02 | 0.02 | 0.02 | 0.02 | 0.02 | 0.02 |
| PEG | — | — | 0.6 | 0.6 | — | 0.6 |
| Perfume | 1.0 | 1.0 | 1.0 | 1.0 | 1.0 | 1.0 |
| Silicone antifoam | 0.01 | 0.01 | 0.01 | 0.01 | 0.01 | 0.01 |
| CAP 6 | 0.4 | 0.1 | 0.8 | 0.2 | 1.0 | 0.6 |
| Electrolyte (ppm) | — | — | 600 | 1200 | — | 1200 |
| Silicone suspending agent | 1.0 | 0.5 | | | | |
| Dye (ppm) | 10 | 10 | 50 | 50 | 10 | 50 |

Water and minors to balance to 100%

Example 27

The following dryer added fabric conditioner compositions were prepared according to the present invention:

| | A | B | C | D |
|---|---|---|---|---|
| DEQA(2) | — | — | — | 50.0 |
| DTMAMS | — | — | 26.0 | — |
| SDASA | 70.0 | 70.0 | 42.0 | 35.0 |
| Neodol 45-13 | 13.0 | 13.0 | — | — |
| Ethanol | 1.0 | 1.0 | — | — |
| CAP 6 | 1.5 | — | 1.5 | 3.0 |
| CAP 7 | 1.5 | 0.2 | 5.0 | 1.0 |
| Perfume | 0.75 | 0.75 | 1.0 | 1.5 |
| Glycoperse S-20 | — | — | — | 10.0 |
| Glycerol monostearate | — | — | 26.0 | — |
| Digeranyl Succinate | 0.38 | 0.38 | — | — |
| Clay | — | — | 3.0 | — |
| Dye | 0.01 | 0.01 | — | — |

Minors to balance to 100%

Example 28

The following are non-limiting examples of pre-soak fabric conditioning and/or fabric enhancement compositions according to the present invention which can be suitably used in the laundry rinse cycle.

| Ingredients | A | B | C | D | E | F |
|---|---|---|---|---|---|---|
| Polymer | 3.5 | 3.5 | 3.5 | 3.5 | 3.5 | 3.5 |
| Dye fixative | 2.3 | 2.3 | 2.4 | 2.4 | 2.5 | 2.5 |
| Polyamine | 15.0 | 15.0 | 17.5 | 17.5 | 20.0 | 20.0 |
| Bayhibit AM | 1.0 | 1.0 | 1.0 | 1.0 | 1.0 | 1.0 |
| $C_{12}$-$C_{14}$ dimethyl hydroxyethyl quaternary ammonium chloride | — | 5.0 | 5.0 | — | — | — |
| Fabric softener active | — | — | 2.5 | 2.5 | — | — |
| Genamin C100 | 0.33 | — | 0.33 | 0.33 | 0.33 | — |
| Genapol V4463 | 0.2 | — | 0.2 | 0.2 | 0.2 | — |
| CAP6 | 2.0 | 4.0 | 0.2 | 1.0 | 0.1 | 0.16 |
| Water & minors | balance | balance | balance | balance | balance | balance |

Example 29

The following are non-limiting examples of odor-absorbing compositions suitable for spray-on applications:

| | Examples | | | | |
|---|---|---|---|---|---|
| Ingredients | A Wt. % | B Wt. % | C Wt. % | D Wt. % | E Wt. % |
| HPBCD | 1.0 | — | 1.0 | — | 1.2 |
| RAMEB | — | 1.0 | — | 0.8 | — |
| Tetronic 901 | — | — | 0.1 | — | — |
| Silwet L-7604 | — | — | — | 0.1 | — |
| Silwet L-7600 | 0.1 | — | — | — | 0.1 |
| Bardac 2050 | — | — | — | 0.03 | — |
| Bardac 2250 | — | 0.2 | — | — | 0.1 |
| Diethylene glycol | — | 1.0 | — | — | 0.2 |
| Triethylene glycol | — | — | 0.1 | — | — |
| Ethanol | — | — | — | — | 2.5 |
| Perfume 1 | 0.1 | — | — | — | — |
| Perfume 2 | — | 0.05 | — | 0.1 | — |

-continued

| Ingredients | Examples A Wt. % | B Wt. % | C Wt. % | D Wt. % | E Wt. % |
|---|---|---|---|---|---|
| Perfume 3 | — | — | 0.1 | — | 0.1 |
| Kathon | 3 ppm | 3 ppm | 3 ppm | 3 ppm | — |
| HCl | to pH 4.5 | to pH 4.5 | to pH 3.5 | to pH 3.5 | to pH 3.5 |
| CAP6 | 5.0 | 2.0 | 1.0 | 0.2 | 0.16 |
| Distilled water | Bal. | Bal. | Bal. | Bal. | Bal. |

The perfume 1, 2, and 3 have the following compositions:

| Perfume Ingredients | Perfume 1 Wt. % | 2 Wt. % | 3 Wt. % |
|---|---|---|---|
| Anisic aldehyde | — | — | 2 |
| Benzophenone | 3 | 5 | — |
| Benzyl acetate | 10 | 15 | 5 |
| Benzyl salicylate | 5 | 20 | 5 |
| Cedrol | 2 | — | — |
| Citronellol | 10 | — | 5 |
| Coumarin | — | — | 5 |
| Cymal | — | — | 3 |
| Dihydromyrcenol | 10 | — | 5 |
| Flor acetate | 5 | — | 5 |
| Galaxolide | 10 | — | — |
| Lilial | 10 | 15 | 20 |
| Linalyl acetate | 4 | — | 5 |
| Linalool | 6 | 15 | 5 |
| Methyl dihydro jasmonate | 3 | 10 | 5 |
| Phenyl ethyl acetate | 2 | 5 | 1 |
| Phenyl ethyl alcohol | 15 | 15 | 20 |
| alpha-Terpineol | 5 | — | 8 |
| Vanillin | — | — | 1 |
| Total | 100 | 100 | 100 |

The invention claimed is:

1. A process for producing a laundry and/or cleaning and/or fabric care composition by combining:

a.) a pre-made carried composition having a viscosity of at least 400 cps at 20° C. and consisting of:

(i) a carrier consisting of a polyisobutylene polymer which is not capable of chemically reacting with a benefit agent, and mixtures thereof; and (ii) a benefit agent, said benefit agent and said carrier being at a weight ratio of from 1:1 to 4:1; and b.) a material selected from the group consisting of a detergent ingredient, a cleaning ingredient, a surfactant, a fabric care ingredient and mixtures thereof; and c.) a bleaching system.

2. The process of claim 1 wherein said carried composition has a dry surface Odor Index of more than 5.

3. The process of claim 1 wherein said carrier is selected from the group consisting of a liquid carrier, a solid carrier, and mixtures thereof.

4. The process of claim 1 wherein said carrier has a molecular weight ranging from 2,000 to 10,000,000.

5. The process of claim 1 wherein said benefit agent is a perfume composition.

6. The process of claim 5 wherein said benefit agent consists of perfume ingredients with a Clog P of at least 2.0 and a boiling point of at least 250° C.

7. A laundry and/or cleaning and/or fabric care composition consisting of:

a.) a pre-made carried composition having a viscosity of at least 400 cps at 20° C. and consisting of:

(i) a carrier consisting of a polyisobutylene polymer which is not capable of chemically reacting with a benefit agent, and mixtures thereof; and (ii) a benefit agent, said benefit agent and said carrier being at a weight ratio of from 1:1 to 4:1; and b.) a material selected from the group consisting of a detergent ingredient, a cleaning ingredient, a surfactant, a fabric care ingredient and mixtures thereof; and c.) and bleaching system.

8. The laundry and/or cleaning and/or fabric care of claim 7, wherein said pre-made carried composition has a dry surface Odor Index of more than 5.

9. The laundry and/or cleaning and/or fabric care composition of claim 7 wherein said carrier is selected from the group consisting of a liquid carrier, a solid carrier, and mixtures thereof.

10. The laundry and/or cleaning and/or fabric care composition of claim 7 wherein said carrier has a molecular weight ranging from 2,000 to 10,000,000.

11. The laundry and/or cleaning and/or fabric care composition of claim 7 wherein said benefit agent is a perfume composition.

12. The laundry and/or cleaning and/or fabric care composition of claim 11 wherein said benefit agent consists of perfume ingredients with a Clog P of at least 2.0 and a boiling point of at least 250° C.

* * * * *